US009860659B2

(12) United States Patent
Won et al.

(10) Patent No.: US 9,860,659 B2
(45) Date of Patent: Jan. 2, 2018

(54) METHOD AND APPARATUS FOR IDENTIFYING FOREIGN SUBSTANCES IN CONNECTORS

(71) Applicant: Samsung Electronics Co., Ltd., Gyeonggi-do (KR)

(72) Inventors: Jin-Hee Won, Gyeonggi-do (KR); Ho-Jun Kim, Gyeonggi-do (KR); Kyung-Min Park, Gyeonggi-do (KR); Gi-Hoon Lee, Gyeonggi-do (KR); Sung-Bin Hong, Seoul (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/953,974

(22) Filed: Nov. 30, 2015

(65) Prior Publication Data

US 2016/0157033 A1 Jun. 2, 2016

(30) Foreign Application Priority Data

Nov. 28, 2014 (KR) ..... 10-2014-0169037

(51) Int. Cl.
*H04R 29/00* (2006.01)
*H04R 1/10* (2006.01)
*H04R 5/04* (2006.01)

(52) U.S. Cl.
CPC ..... *H04R 29/00* (2013.01); *H04R 1/1091* (2013.01); *H04R 5/04* (2013.01); *H04R 1/1033* (2013.01); *H04R 1/1041* (2013.01)

(58) Field of Classification Search
CPC .. H04R 1/1033; H04R 1/1008; H04R 1/1041; H04R 5/033; H04R 2420/09; H04M 5/02; H01R 2201/16; H01R 39/54; H01R 9/2491; H01R 13/26; H01R 24/62; H01R 23/025; H01R 23/10; H01R 23/26
USPC ..... 381/309, 74, 370, 384, 58
See application file for complete search history.

(56) References Cited

U.S. PATENT DOCUMENTS

2012/0257768 A1* 10/2012 Park ..... H04M 1/6058 381/94.5
2014/0055167 A1 2/2014 Oh et al.
2014/0064512 A1 3/2014 Yu et al.
2015/0326970 A1* 11/2015 Miske ..... H04R 3/00 381/123

FOREIGN PATENT DOCUMENTS

KR 10-2014-0026722 A 3/2014
KR 10-2014-0030425 A 3/2014

* cited by examiner

*Primary Examiner* — Md S Elahee
*Assistant Examiner* — Sabrina Diaz
(74) *Attorney, Agent, or Firm* — Cha & Reiter, LLC.

(57) ABSTRACT

An electronic device comprising: a memory; a headphone jack; and at least one processor operatively coupled to the memory, configured to: detect an impedance of a first portion of the headphone jack; and detect whether a foreign substance is present in the headphone jack based on the impedance of the first portion of the headphone jack.

17 Claims, 12 Drawing Sheets

<EAR JACK TERMINAL RECOGNITION STATE>

METHOD AND APPARATUS FOR IDENTIFYING FOREIGN SUBSTANCES IN CONNECTORS

CLAIM OF PRIORITY

This application claims the priority under 35 U.S.C. §119(a) to Korean Application Serial No. 10-2014-0169037, which was filed in the Korean Intellectual Property Office on Nov. 28, 2014, the entire content of which is hereby incorporated by reference.

TECHNICAL FIELD

The present disclosure relates to electronic devices, in general, and more particularly to a method and apparatus for identifying foreign substances in connectors.

BACKGROUND

Recently, with the development of a multimedia technology, an electronic device having various functions is emerging. For example, an electronic device, such as a smartphone which has recently been released, provides various functions that support input and/or output of an audio signal (e.g., a call function, a music file playback function, a high-quality video playback function).

In general, in order to support the input and/or output of an audio signal, an electronic device detects whether an earphone is inserted into an ear jack (i.e., a headphone jack) of the electronic device, and when the earphone insertion is detected, the electronic device performs an input and/or output function of the audio signal.

However, in place of an earphone, a foreign substance may flow into the ear jack of the electronic device, and the electronic device may recognize the foreign substance as the insertion of the earphone. When the electronic device recognizes the foreign substance flowing into the ear jack as the earphone insertion, the electronic device malfunctions, and this will eventually result in an inconvenience to a user.

SUMMARY

According to aspects of the disclosure, an electronic device is provided comprising: a memory; a headphone jack; and at least one processor operatively coupled to the memory, configured to: detect an impedance of a first portion of the headphone jack; and detect whether a foreign substance is present in the headphone jack based on the impedance of the first portion of the headphone jack.

According to aspects of the disclosure, a method is provided comprising: detecting, by at least one processor, whether a headphone plug or a foreign substance is present in an headphone jack; and in response to detecting that one of the headphone plug or the foreign substance is present in the headphone jack, detecting which one of the headphone plug and the foreign substance is present in the headphone jack based on an impedance of a first portion of the headphone jack.

According to aspects of the disclosure, a non-transitory computer-readably medium is provided that stores one or more processor-executable instructions, which when executed by at least one processor cause the at least one processor to execute a process comprising the steps of: detecting whether a headphone plug or a foreign substance is present in an headphone jack; and in response to detecting that one of the headphone plug or the foreign substance is present in the headphone jack, detecting which one of the headphone plug and the foreign substance is present in the headphone jack based on an impedance of a first portion of the headphone jack.

BRIEF DESCRIPTION OF THE DRAWINGS

The above and other aspects, features, and advantages of the present disclosure will be more apparent from the following detailed description, when taken in conjunction with the accompanying drawings, in which.

DETAILED DESCRIPTION

Figure 1A:
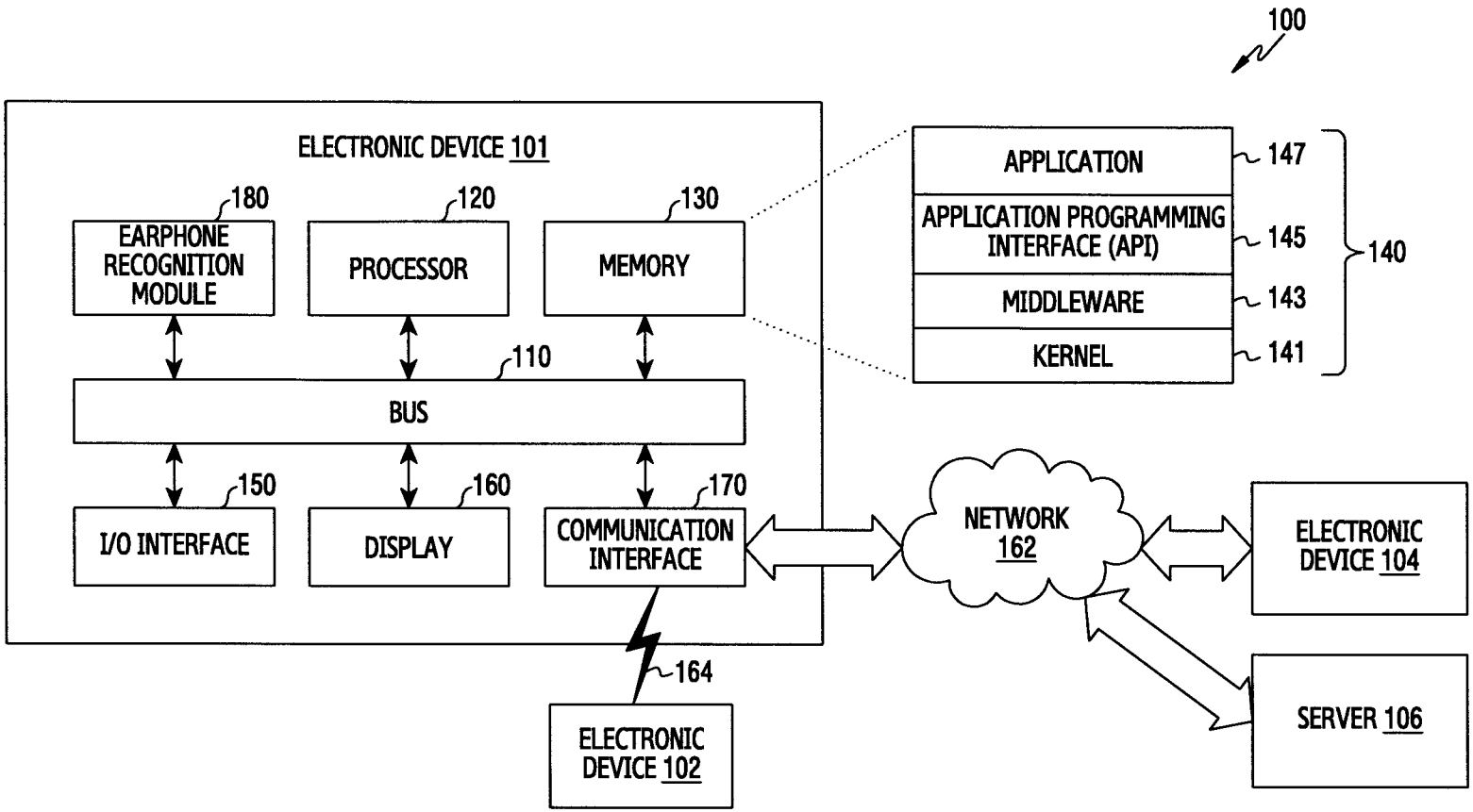
FIG. 1A is a diagram of an example of a network environment that includes an electronic device, according to an embodiment of the present disclosure.

Hereinafter, various exemplary embodiments of the present disclosure will be described with reference to the accompanying drawings. The present disclosure may be modified in various forms and include various embodiments, but specific examples are illustrated in the drawings and described in the description. However, it should be understood that there is no intent to limit the present disclosure to the particular forms disclosed herein; rather, the present disclosure should be construed to cover all modifications, equivalents, and/or alternatives falling within the spirit and scope of the disclosure. In the description of the drawings, identical or similar reference numerals are used to designate identical or similar elements.

The term "include" or "may include" refers to the existence of a corresponding disclosed function, operation or component which can be used in various embodiments of the present disclosure and does not limit one or more additional functions, operations, or components. Further, as used in embodiment of the present disclosure, the terms "include", "have" and their conjugates may be construed to denote a certain characteristic, number, step, operation, constituent element, component or a combination thereof, but may not be construed to exclude the existence of or a possibility of addition of one or more other characteristics, numbers, steps, operations, constituent elements, components or combinations thereof.

In various embodiments of the present disclosure, the expression "or" or "at least one of A or/and B" includes any or all of combinations of words listed together. For example, the expression "A or B" or "at least A or/and B" may include A, may include B, or may include both A and B.

The expression "1", "2", "first", or "second" used in various embodiments of the present disclosure may modify various components of various embodiments but does not limit the corresponding components. For example, the above expressions do not limit the sequence and/or importance of the corresponding elements. The above expressions are used merely for the purpose of distinguishing an element from the other elements. For example, a first user device and a second user device indicate different user devices although both of them are user devices. For example, a first element could be termed a second element, and similarly, a second element could be also termed a first element without departing from the scope of the present disclosure.

It should be noted that if it is described that one component element is "coupled" or "connected" to another component element, the first component element may be directly coupled or connected to the second component, and a third component element may be "coupled" or "connected" between the first and second component elements. Conversely, when one component element is "directly coupled" or "directly connected" to another component element, it may be construed that a third component element does not exist between the first component element and the second component element.

As used herein, terms are used merely for describing specific embodiments and are not intended to limit the present disclosure. As used herein, the singular forms are intended to include the plural forms as well, unless the context clearly indicates otherwise.

Unless defined otherwise, all terms used herein, including technical and scientific terms, have the same meaning as commonly understood by those of skill in the art to which the present disclosure pertains. Such terms as those defined in a generally used dictionary are to be interpreted to have the meanings equal to the contextual meanings in the relevant field of art and are not to be interpreted to have ideal or excessively formal meanings unless clearly defined in the present disclosure.

According to some embodiments, the electronic device may be a device that supports an audio input/output function via an earphone. For example, the electronic device may include at least one of a smartphone, a tablet personal computer (PC), a mobile phone, a video phone, an electronic book (e-book) reader, a desktop PC, a laptop PC, a netbook computer, a personal digital assistant (PDA), a portable multimedia player (PMP), an MP3 player, a mobile medical appliance, a camera, and a wearable device (e.g., a head-mounted-device (HMD) such as electronic glasses, electronic clothes, an electronic bracelet, an electronic necklace, an electronic appcessory, electronic tattoos, or a smart watch).

According to some embodiments, the electronic device may be a smart home appliance for supporting an audio input/output function via the earphone. The smart home appliance as an example of the electronic device may include at least one of a television, a Digital Video Disk (DVD) player, an audio, a refrigerator, an air conditioner, a vacuum cleaner, an oven, a microwave oven, a washing machine, an air cleaner, a set-top box, a TV box (e.g., Samsung HomeSync™, Apple TV™, or Google TV™), a game console, an electronic dictionary, an electronic key, a camcorder, and an electronic picture frame.

According to some embodiments, the electronic device may include at least one of various medical appliances (e.g. Magnetic Resonance Angiography (MRA), Magnetic Resonance Imaging (MRI), Computed Tomography (CT) machine, and an ultrasonic machine), navigation devices, Global Positioning System (GPS) receivers, Event Data Recorders (EDRs), Flight Data Recorders (FDRs), automotive infortainment devices, electronic equipment for ships (e.g. navigation equipment for ships, gyrocompasses, or the like), avionics, security devices, head units for vehicles, industrial or home robots, Automatic Teller Machines (ATM) of banking facilities, and Point Of Sales (POSs) of shops for supporting an audio input/output function via the earphone.

According to some embodiments, the electronic device may include at least one of a part of furniture or a building/structure, an electronic board, an electronic signature receiving device, a projector, and various kinds of measuring instruments (e.g., a water meter, an electric meter, a gas meter, and a radio wave meter) for supporting an audio input/output function via the earphone. In various embodiments, the electronic device may be a combination of one or more of the aforementioned various devices. Also, the electronic device according to the present disclosure may be a flexible device. Further, it is obvious to those skilled in the art that the electronic device according to the present disclosure is not limited to the aforementioned devices.

Hereinafter, an electronic device according to various embodiments will be described with reference to the accompanying drawings. The term "user" used in various embodiments may refer to a person who uses an electronic device or a device (for example, an artificial intelligence electronic device) that uses an electronic device.

An embodiment of the present disclosure may prevent a foreign substance, which has flowed into an ear jack in an electronic device, from being misrecognized as the earphone.

An embodiment of the present disclosure may provide a method and device for determining whether a foreign substance flows or not, based on whether a plurality of terminals configuring an ear jack in an electronic device are electrically connected to each other.

An embodiment of the present disclosure may provide a method and device for determining whether a foreign substance has entered an ear jack, based on the measurability of impedance of an ear jack right terminal among a plurality of terminals configuring an ear jack in an electronic device.

An embodiment of the present disclosure may provide a method and device for determining whether a foreign substance has entered an ear jack, based on whether a signal output to the ear jack right terminal is detected through an ear jack left terminal, among a plurality of terminals configuring an ear jack in an electronic device.

Various embodiments of the present disclosure will describe a method and device for determining an inflow of a foreign substance into an ear jack in an electronic device.

FIG. 1A shows a network environment 100 including an electronic device according to an embodiment of the present disclosure.

Referring to FIG. 1, the electronic device 101 may include a bus 110, a processor 120, a memory 130, an input/output interface 150, a display 160, a communication interface 170, and an earphone recognition module 180.

The bus 110 may be a circuit connecting the components of the electronic device 101 with each other and transmitting communications (for example, a control message and/or data) between the components of the electronic device 101.

The processor 120 may include any suitable type of processing circuitry, such as one or more general-purpose processors (e.g., ARM-based processors), a Digital Signal Processor (DSP), a Programmable Logic Device (PLD), an Application-Specific Integrated Circuit (ASIC), a Field-Programmable Gate Array (FPGA), etc. According to an embodiment, the processor 120 may include a codec or Power Management IC (PMIC). The processor 120 may receive, for example, commands from other elements (e.g., the memory 130, the input/output interface 150, the display 150, the communication interface 160, and an earphone recognition module 180) of the electronic device 101 via the bus 110, interpret the received commands, and perform calculations or data processing according to the interpreted commands.

According to an embodiment of the present disclosure, the earphone recognition module 180 may determine, through the input/output interface 150, whether an earphone is present in an ear jack or a foreign substance flows into the ear jack. For example, the earphone recognition module 180 may detect whether at least two portions of the ear jack are electrically connected to each other and determine whether an earphone plug has been inserted into an ear jack or a foreign substance has entered the ear jack based on whether the portions are electrically connected with one another.

The ear jack may include an ear jack left portion, an ear jack right portion, an ear jack ground portion, and an ear jack microphone portion. The ear jack left portion may contact a left terminal of the earphone plug, the ear jack right portion may contact a right terminal of the earphone plug, the ground portion of the ear jack may contact a ground terminal of the earphone plug, and the ear jack microphone portion may contact a microphone terminal of the earphone plug. For example, the earphone recognition module 180 may test whether: (1) measuring the impedance of the ear jack right portion of the ear jack is possible, and (2) the ear jack right portion and the ear jack left portion are electrically connected to each other and use the outcome of the test(s) to determine whether an earphone plug or a foreign substance is present in the ear jack.

According to an embodiment, when detecting that a foreign substance has entered an ear jack, the earphone recognition module 180 may output, on the display 160 (or another output device), an alert that a foreign substance is present in the ear jack. For example, the earphone recognition module 180 may control the display 160 to display a message requesting the user to remove the foreign substance from the ear jack.

According to an embodiment, the output of the alert can be performed by the processor 120. For example, the processor 120 may detect the presence of the foreign substance by using the earphone recognition module 180. More particularly, the processor 120 may receive, from the earphone recognition module 180, a signal indicating that the foreign substance is present in the ear jack, and in this case, the processor 120 may display, through the display 160, graphic elements notifying of the presence of the foreign substance in the ear jack.

The memory 130 may include any suitable type of volatile or non-volatile memory, such as Random-access Memory (RAM), Read-Only Memory (ROM), Network Accessible Storage (NAS), cloud storage, a Solid State Drive (SSD), etc. The memory 130 may store commands or data received from the processor 120 or other elements (e.g., the input/output interface 150, the display 160, the communication interface 170, and the earphone recognition module 180) or generated by the processor 120 or other elements. The memory 130 may include programming modules 140, for example, a kernel 141, middleware 143, an application programming interface (API) 145, an application 147, and the like. Each of the programming modules may be implemented in software, firmware, hardware, or a combination of two or more thereof. At least some of the kernel 141, the middleware 143, the API 145 can be referred to as an operation system. The memory 130 may include a volatile memory and/or a non-volatile memory.

The input/output interface 150 may serve as an interface that may transfer commands or data input from a user or another external device (e.g., an earphone) to at least one other element of the electronic device 101. For example, the input/output interface 150 may transmit commands or data input from the user via input devices (e.g., a sensor, a keyboard, a touch screen, and a microphone of the earphone which are connected via an ear jack) via a bus 110 to the processor 120, the memory 130, and the communication interface 170. The input/output interface 150 may transmit commands or data that has been generated by or requested from at least one other element of the electronic device 101 to an output device (e.g. a touch screen and an earphone connected through the ear jack). According to an embodiment, the input/output interface 150 may include an ear jack and circuit elements for detecting whether the plug of the earphone is inserted and/or the foreign substance flows into the ear jack.

The display 160 may display various pieces of information (e.g., multimedia data, text data, graphic data, etc.) to a user. For example, the display 160 may display, via the bus 110, a command or data received from the processor 120, the memory 130, and the communication interface 170. For example, the display 160 may display graphic data indicating that the earphone has been connected to the electronic device 101, or may display graphic data indicating that the foreign substance has entered the ear jack of the electronic device 101.

The communication interface 170 may connect communication between the electronic device 101 and an electronic device (e.g., the electronic device 104 or the server 106). For example, the communication interface 170 may communicate with the external device by connecting to the network via wireless communication or wired communication. The wireless communication may include at least one of, for example, Wi-Fi, Neighbor Awareness Networking (NAN), Bluetooth (BT), Near Field Communication (NFC), Ultrasonic communication, a global positioning system (GPS), and cellular communication (e.g. LTE, LTE-A, CDMA, WCDMA, UMTS, WiBro, GSM, etc.). The wired communication may include at least one of, for example, a universal serial bus (USB), a high definition multimedia interface (HDMI), recommended standard 232 (RS-232), and a plain old telephone Service (POTS).

According to an embodiment, a network may be a telecommunication network. The telecommunication network may include at least one of a computer network, the Internet, Internet of Things, and a telephone network. According to an embodiment, at least one of the application 147, the API 145, the middleware 143, the kernel 141, and the communication interface 170, which are included in the memory 130, may support a protocol (e.g., a transport layer protocol, a data link layer protocol, or a physical layer protocol) for communication between the electronic device 101 and an external device.

According to various embodiments, all or some of the operations performed in the electronic device 101 may be performed in another electronic device or a plurality of electronic devices (e.g., the electronic device 04 or the server 106). According to an embodiment, when the electronic device 101 has to automatically perform a function or a service or perform by the request, the electronic device 101 may perform the function or the service autonomously or may request the other device (for example, the electronic device 104 or server 106) for at least some of the functions associated with the function or the service. The other electronic device may perform the requested function or an additional function, and transmit a result of the performance to the electronic device 101. The electronic device 101 may process the received result as it is or additionally to provide the requested functions or services. To achieve this, for example, cloud computing, distributed computing, or client-server computing technology may be used.

Figure 1B:
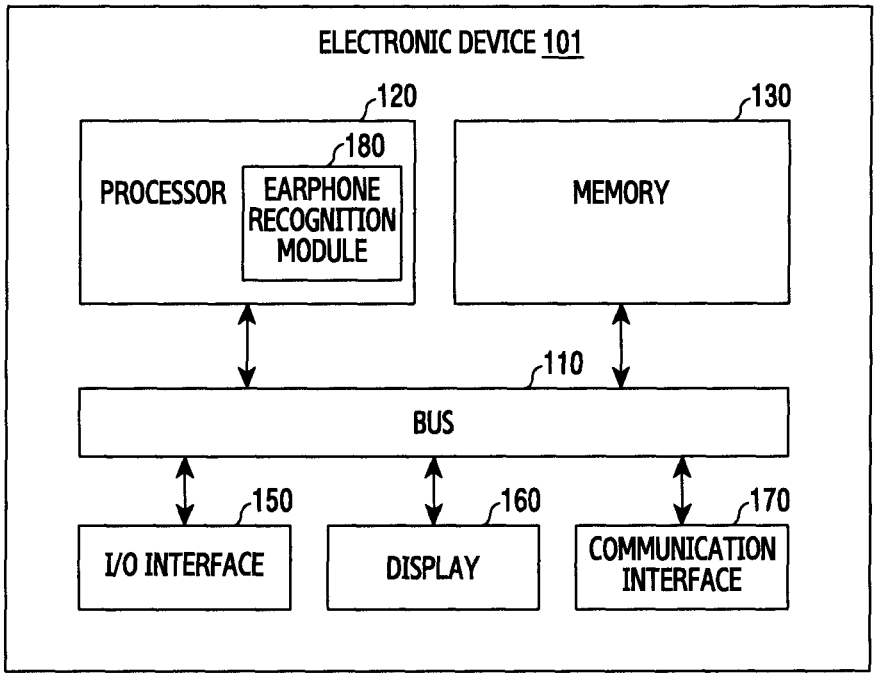
FIG. 1B is a diagram of an example of an electronic device a, according to an embodiment of the present disclosure.

FIG. 1A illustrates an embodiment in which the earphone recognition module 180 is separate from the processor 120. However, according to various embodiments of the present disclosure, as shown in FIG. 1B, the earphone recognition module 180 may be integrated into (or replaced by) the processor 120. In such instances, the functions of the above-described earphone recognition module 180 may be performed by the processor 120. Among the configuration elements of the electronic device 101 shown in FIG. 1B, remaining elements other than the processor 120 (e.g., the bus 110, the processor 120, the memory 130, the input/output interface 150, the display 160, the communication interface 170, etc.) may perform the same functions as described in FIG. 1A.

Figure 2:
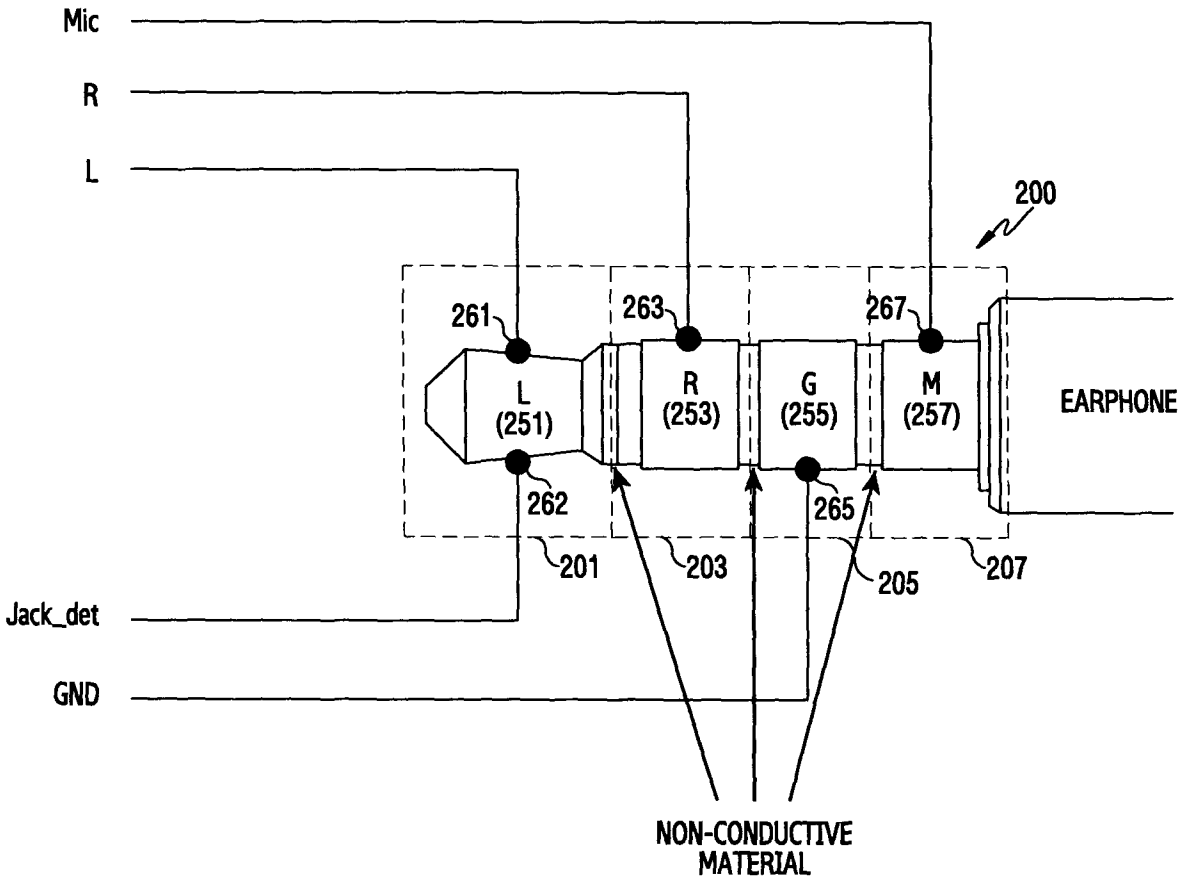
FIG. 2 is a diagram of an example of an example of an ear jack and an earphone plug, according to an embodiment of the present disclosure.

FIG. 2 is a diagram of an example of an electronic device, according to an embodiment of the present disclosure.

Referring to FIG. 2, an ear jack 200 of the electronic device 101 may include a socket and an earphone plug. The ear jack may include pins 261, 262, 263, 265, and 267 which come in contact with an earphone plug when the earphone plug is inserted into the ear jack. The ear jack 200 may include a left portion 201 including pins 261 and 262 which contact a left terminal 251 of the earphone plug, an ear jack right portion 203 including a pin 263 which contacts a right terminal 253 of the earphone plug, an ear jack ground portion 205 including a pin 265 which contacts a ground terminal 255 of the earphone plug, and an ear jack microphone portion 207 including a pin 267 which contacts a microphone terminal 257 of the earphone plug. According to an embodiment of the present disclosure, the ear jack left portion 201 and the ear jack right portion 203 can be configured not to transmit electric signals to each other. Further, according to an embodiment of the present disclosure, the ear jack left portion 201, the ear jack right portion 203, the ear jack ground portion 205, and the ear jack microphone portion 207 can be configured not to transmit electric signals to each other.

It should be noted that the present disclosure is not limited to any particular ordering of the ear jack left, ear jack right, ear jack ground, and ear jack microphone portions of the ear jack 200 and various embodiments can be devised in which the order of the left portion 251 and the right portion 253 of the earphone plug is changed, for example, the earphone plug can be configured in the order of the right portion 253, the left portion 251, the ear jack ground portion 205, and the ear jack microphone portion 207. Furthermore, embodiments of the present disclosure describe a four-pole earphone (e.g., L/R/G/M) as an example and may be applied to a three-pole earphone (e.g., L/R/G) in the same method.

Figure 3:
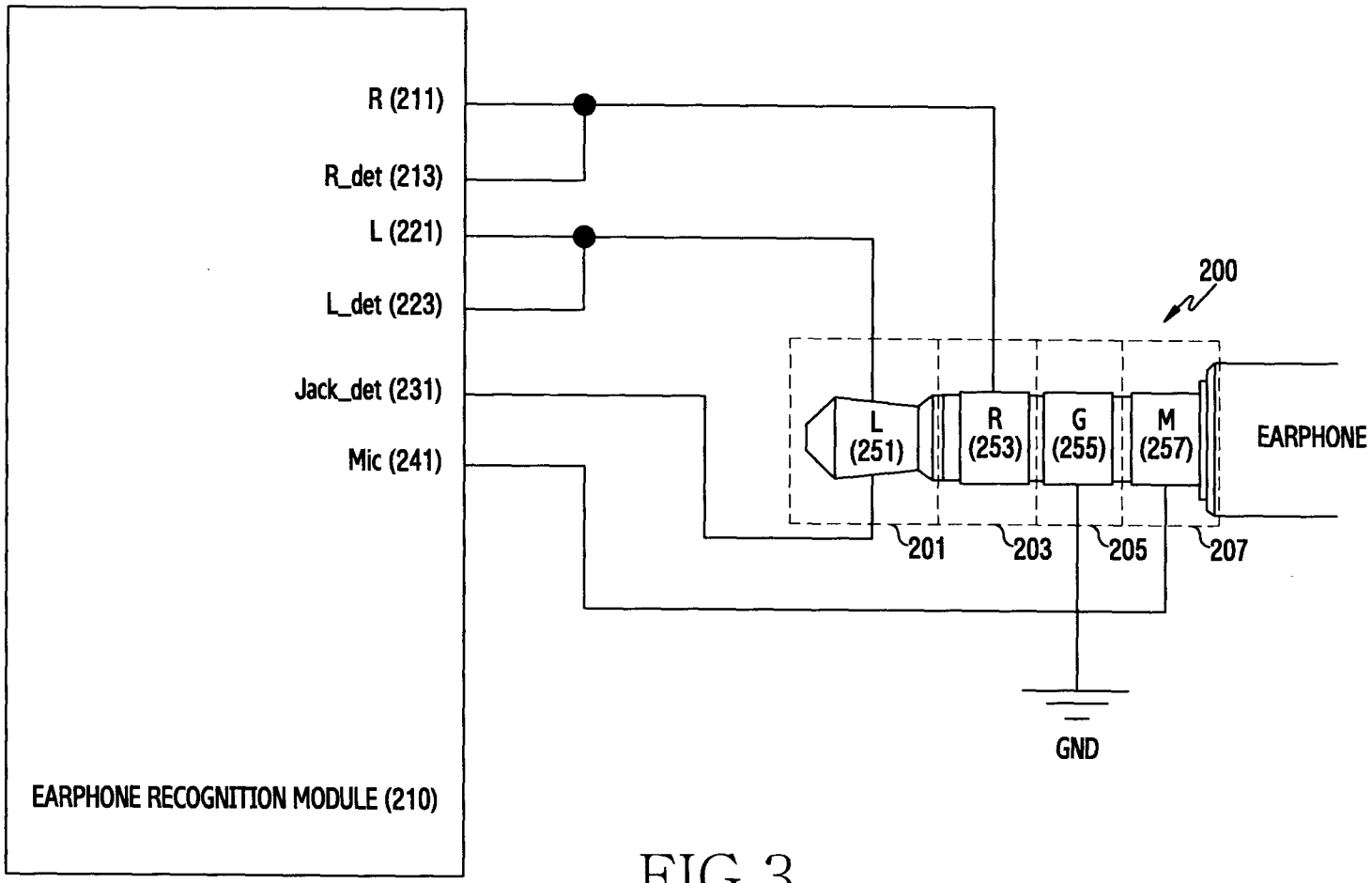
FIG. 3 is a diagram of an example of a circuit for detecting the presence of a foreign substance in an earphone jack, according to an embodiment of the present disclosure.

FIG. 3 is a diagram of an example of a circuit for detecting the presence of a foreign substance in an earphone jack, according to an embodiment of the present disclosure.

Referring to FIG. 3, an electronic device 101 may include an earphone recognition module 210 for detecting whether the plug of the earphone is inserted into to the ear jack 200 or a foreign substance has found its way into the ear jack. For example, the earphone recognition module 210 may include an R-pin 211 connected to the ear jack right portion 203 for feeding a first audio signal to the ear jack right portion 203, an L pin 221 connected to the ear jack left portion 201 for feeding a second audio signal to the ear jack left portion 201, a Jack_det pin 231 connected to the ear jack left portion 201 for detecting whether the earphone is plugged in, and a Mic pin 241 connected to the ear jack microphone portion for receiving an audio signal from the earphone. Further, according to an embodiment of the present disclosure, the earphone recognition module 210 may include R_det pin 213 that is coupled to a signal line connecting the ear jack right portion 203 and R-pin 211 for measuring the impedance of the ear jack right portion 203 or detecting a signal input from the ear jack right portion 203. Furthermore, according to an embodiment of the present disclosure, the earphone recognition module 210 may include L_det pin 223 that is coupled to a signal line connecting the ear jack left portion 201 and L-pin 221 for measuring the impedance of the ear jack left portion 201 or detecting a signal input from the ear jack left portion 201. According to various embodiments of the present disclosure, when the earphone plug is configured in the order of the left terminal 251, the right terminal 253, the ear jack ground portion 205, and the ear jack microphone portion 207, the earphone recognition module 210 may measure the impedance of the ear jack right portion 203 using R_det pin 213 and detect a signal received at the ear jack left portion 201 using an L_det pin 223. According to various embodiments of the present disclosure, when the order of the left terminal 251 and the right terminal 253 of the earphone plug is changed, for example, the earphone plug is configured in the order of the right terminal 253, the left terminal 251, the ear jack ground portion 205, and the ear jack microphone portion 207, the earphone recognition module 210 may measure the impedance of the ear jack left portion 205 using an L_det pin 223 and detect a signal input from the ear jack right portion 203 using R_det pin 213. Although not shown in the drawings, at least one circuit element such as a resistor, a capacitor, and an inductor can be included between each pin included in the earphone recognition module 210 and an ear jack connected to the pin.

Figure 4:
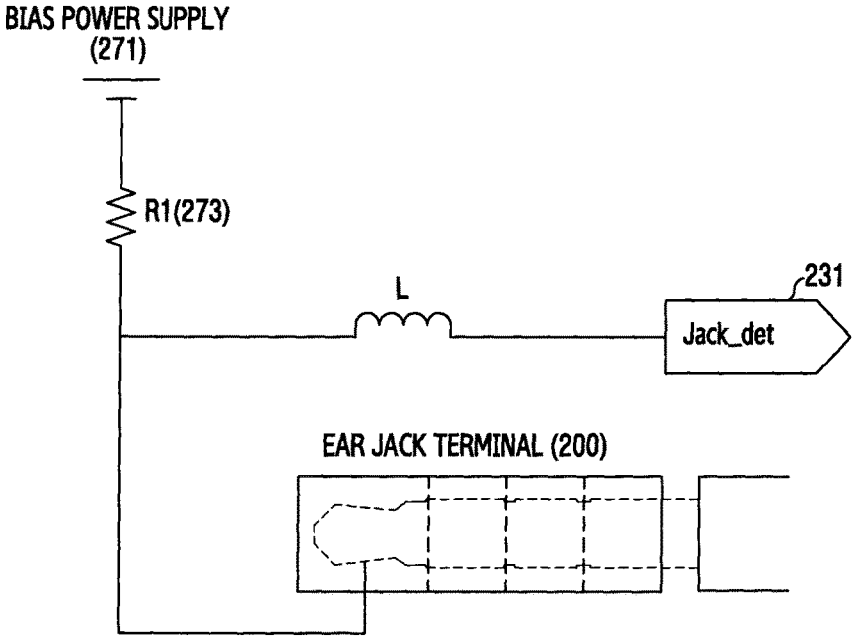
FIG. 4 is a diagram of an example of a circuit for detecting the presence of a foreign substance in an earphone jack, according to an embodiment of the present disclosure.

According to an embodiment of the present disclosure, the earphone recognition module 210 may detect the insertion of the earphone plug or the inflow of foreign substances (for example, water, substances containing moisture, a conductor, etc.) into the ear jack 200 using a Jack_det pin 231. For example, the earphone recognition module 210 may receive, from the Jack_det pin 231, an input signal indicating that the earphone plug or the foreign substance is detected in the ear jack 200. More particularly, when the earphone plug is inserted or foreign substance flows into the ear jack 200, the earphone recognition module 210 may detect a low signal (or an enable signal) from a Jack_det pin 231, and when the earphone plug is not inserted or the foreign substance has not entered the ear jack 200, the earphone recognition module 210 may detect a high signal (or a disable signal) from a Jack_det pin 231. As illustrated in FIG. 4, the Jack_det pin 231 and the ear jack 200 can be connected to a bias power supply 271 and a pull-up resistor R1 273. When the earphone plug is not inserted into and no foreign substance is present in the ear jack 200, a bias voltage is provided to the Jack_det pin 231 via the pull-up resistor R1 273, and the earphone recognition module 210 may detect a high signal through the Jack_det pin 231. On the other hand, when the earphone plug is inserted or a foreign substance has entered the ear jack 200, the bias voltage is divided between the Jack_det pin 231 and the ear jack 200 as a result of the resistance of the earphone plug or the resistance of the foreign substance, and the earphone recognition module 210 may detect a low signal through the Jack_det pin 231.

When a low signal is detected from Jack_det pin 231, the earphone recognition module 210 may output a foreign substance detection signal to the ear jack right portion 203 through the R_det pin 213. For example, the foreign substance detection signal may be one having a predetermined voltage. The earphone recognition module 210 may output the foreign substance detection signal, through the R_det pin 213, to the ear jack right portion 203 and then measure the impedance of the ear jack right portion 203 by using the R_det pin 213. The earphone recognition module 210 may determine whether the earphone plug is inserted or the foreign substance has entered the ear jack 200 on the basis of a result of measuring the impedance of the ear jack right portion 203 using the R_det pin 213. As used in this example, the terms "low signal" and "high signal" may refer to signals having a first voltage and second voltage, respectively, wherein the second voltage is higher than the first voltage.

When the impedance measurement through the R_det pin 213 is not possible, (e.g., when the impedance exceeds a threshold), the earphone recognition module 210 may determine that the foreign substance has entered the ear jack 200.

When the impedance value is measurable (e.g., when the impedance is less than the threshold), the earphone recognition module 210 may detect whether the foreign substance detection signal can flow into the ear jack left portion 201 via the L_det pin 223. For example, when the foreign substance detection signal that is output to the ear jack right portion 203 is input to the L_det pin 223 in a state where the impedance measurement through the R_det pin 213 is possible, the earphone recognition module 210 may determine that a foreign substance is present in the ear jack 200. For example, when the foreign substance such as moisture has entered the ear jack left portion 201 and the ear jack right portion 205, the ear jack left portion 201 and the ear jack right portion can be electrically connected to each other due to the foreign substance. When the ear jack left portion 201 and the ear jack right portion 205 are electrically connected by the foreign substance, the foreign substance detection signal, which is output to the ear jack right portion 203 through R_det pin 213, may be input through the L_det pin 223.

When the foreign substance detection signal that is output to the ear jack right portion 203 is not received at the L_det pin 223, the earphone recognition module 210 may determine that the earphone plug is inserted into the ear jack 200.

As described above, the earphone recognition module 210 according to an embodiment of the present disclosure may determine that whether the earphone plug is inserted or the foreign substance flows into the ear jack 200 based on the result of the impedance measurement using the R_det pin 213 and the ear jack recognition state indicating whether to input the signal to the L_det pin 223.

Figure 5A:
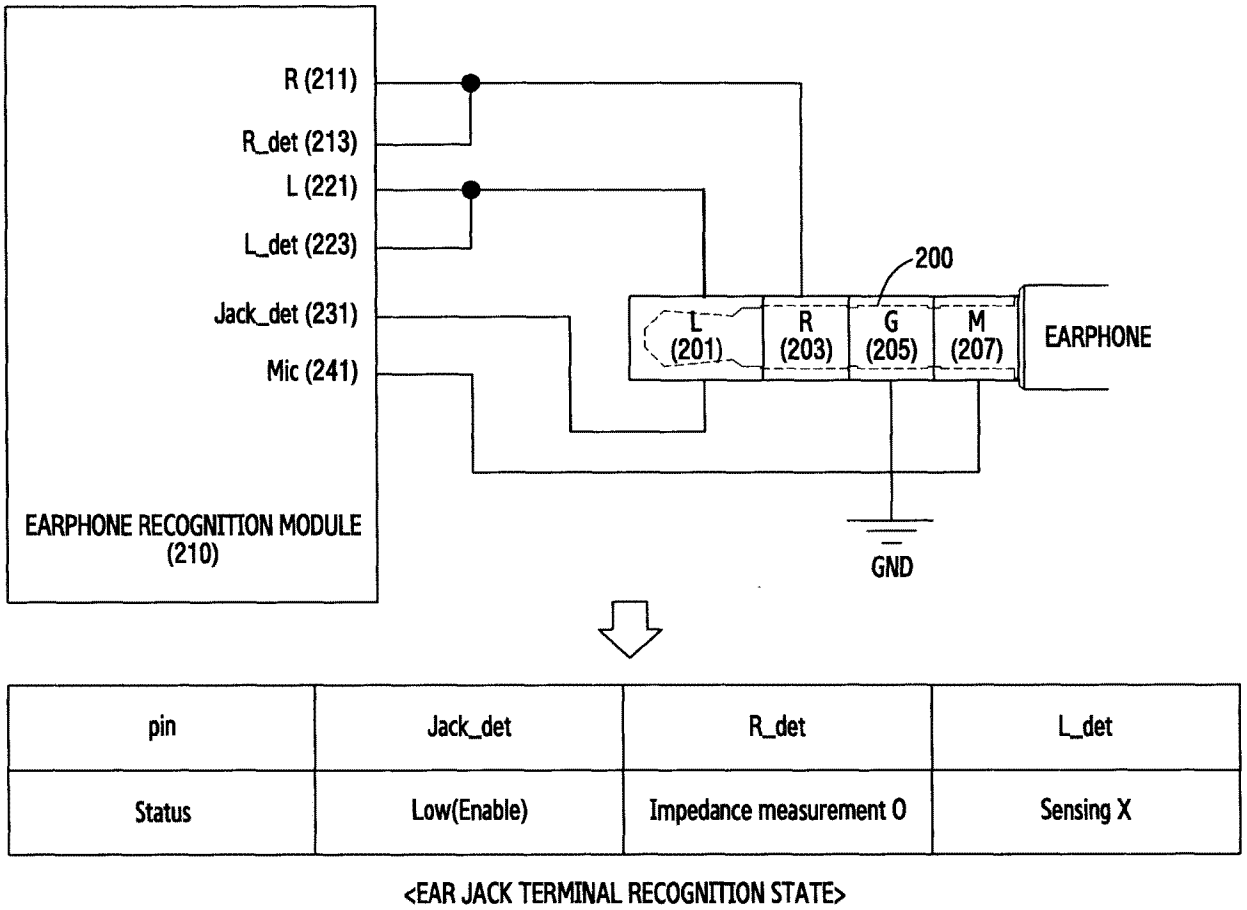
FIG. 5A is a diagram illustrating a first state of an ear jack, according to an embodiment of the present disclosure.

FIG. 5A is a diagram illustrating a first state of the ear jack 200 in which an earphone plug is present in the ear jack 200, according to an embodiment of the present disclosure. As shown in FIG. 5A, when the plug of the earphone is inserted into the ear jack of an electronic device 200, the earphone recognition module 210 may receive a low signal from the Jack_det pin 231 and may detect that the earphone plug or foreign substance is present in the ear jack 200. For example, referring to FIG. 4, when the earphone plug is inserted into the ear jack 200, the bias voltage is divided between the Jack_det pin 231 and the ear jack 200 by the resistance of the earphone plug and a pull-up resistor R1 273 so that a voltage lower than the bias voltage is received at the Jack_det pin 231. In this case, the earphone recognition module 210 may determine that the low signal is received at the Jack_det pin 231.

In order to determine whether the earphone plug is inserted or foreign substance is present in the ear jack 200, the earphone recognition module 210 may output a foreign substance detection signal to the ear jack right portion 203 through the R_det pin 213 and measure the impedance of the ear jack right portion 203 by using the R_det pin 213. At this time, since the ear jack right portion 203 is in contact with the right terminal of the earphone plug, the earphone recognition module 210 may measure the impedance of the right terminal of the earphone plug. When the impedance value is measured through the R_det pin 213, the earphone recognition module 210 may detect whether the foreign substance detection signal that is output to the ear jack right portion 203 is received at the L_det pin 223. At this time, since the right terminal of the earphone plug in contact with the ear jack right portion 203 and the left terminal of the earphone plug that is connected to the ear jack left portion 201 are separated from each other such that an electrical signal does not pass through the terminals, the foreign substance detection signal that is output to the ear jack right portion 203 will not be received at the ear jack left portion 201. Therefore, the earphone recognition module 210 may detect that the foreign substance detection signal that is output to the ear jack right portion 203 and is not transmitted to the ear jack left portion 201.

According to an embodiment of the present disclosure, as shown in FIG. 5A, when a low signal is detected through the Jack_det pin 231, the impedance value is measurable through the R_det pin 213, and the foreign substance detection signal is not received at the L_det pin 223, the earphone recognition module 210 may determine that the earphone plug is inserted into the ear jack 200.

Figure 5B:
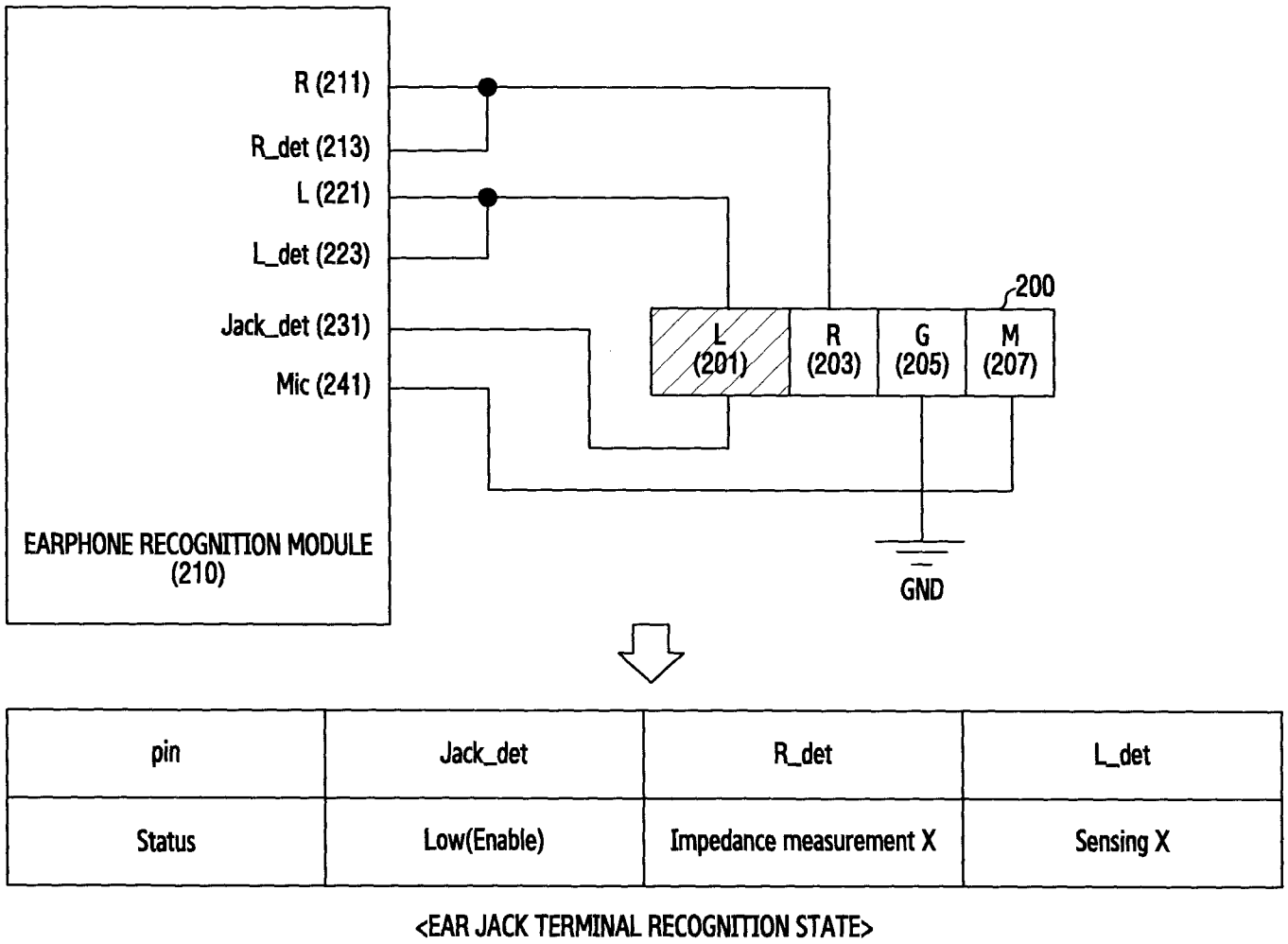
FIG. 5B is a diagram illustrating a second state of an ear jack, according to an embodiment of the present disclosure.

FIG. 5B is a diagram illustrating a second state of the ear jack 200 in which a foreign substance is present in the portion 201 of the ear jack 200, according to an embodiment of the present disclosure.

As shown in FIG. 5B, when a foreign substance enters the ear jack left portion 201 of the ear jack 200 in an electronic device, the earphone recognition module 210 may receive a low signal from the Jack_det pin 231 and detect that an earphone plug or a foreign substance is present within the ear jack 200. For example, referring to FIG. 4, when the foreign substance enters the ear jack 200, the bias voltage is divided between the Jack_det pin 231 and the ear jack 200 by the resistance of the earphone plug and a pull-up resistor R1 273 so that a voltage lower than the bias voltage is received at the Jack_det pin 231. In this case, the earphone recognition module 210 may determine that the low signal is received at the Jack_det pin 231.

In order to determine whether the earphone plug is inserted into the ear jack 200 or the foreign substance enters the ear jack 200, the earphone recognition module 210 may output a foreign substance detection signal to the ear jack right portion 203 through the R_det pin 213 and measure the impedance of the ear jack right portion 203 by using the R_det pin 213. At this time, since the ear jack right portion 203 is not in contact with the foreign substance or the earphone plug, a high impedance state, for example, an opened state can be measured. Therefore, the earphone recognition module 210 may not measure the impedance value due to the foreign substance detection signal via the R_det pin 213. When the opened state due to the high impedance of the ear jack right portion 203 is measured, the earphone recognition module 210 may determine that the foreign substance is present in the ear jack left portion 201.

Further, when the impedance value is not measurable through the R_det pin 213, the earphone recognition module 210 may detect whether the foreign substance detection signal that is output to the ear jack right portion 203 is received at the L_det pin 223. At this time, since the ear jack right portion 203 is not in contact with the earphone plug and the foreign substance, the foreign substance detection signal that is output to the ear jack right portion 203 may not be transmitted to the left portion 201. Therefore, the earphone recognition module 210 may detect that the foreign substance detection signal that is output to the ear jack right portion 203 is not transmitted to the ear jack left portion 201.

According to an embodiment of the present disclosure, as shown in FIG. 5B, when a low signal is detected through the Jack_det pin 231, the impedance value is not measurable through the R_det pin 213, and the foreign substance detection signal is not received at the L_det pin 223, the earphone recognition module 210 may determine that the foreign substance is present in the ear jack left portion 201. According to an embodiment of the present disclosure, as shown in FIG. 5B, when a low signal is detected through the Jack_det pin 231 and the impedance value is not measurable through the R_det pin 213, the earphone recognition module 210 may determine that the foreign substance is inserted into the ear jack 200 without detecting whether the foreign substance detection signal is received at the L_det pin 223.

Figure 5C:
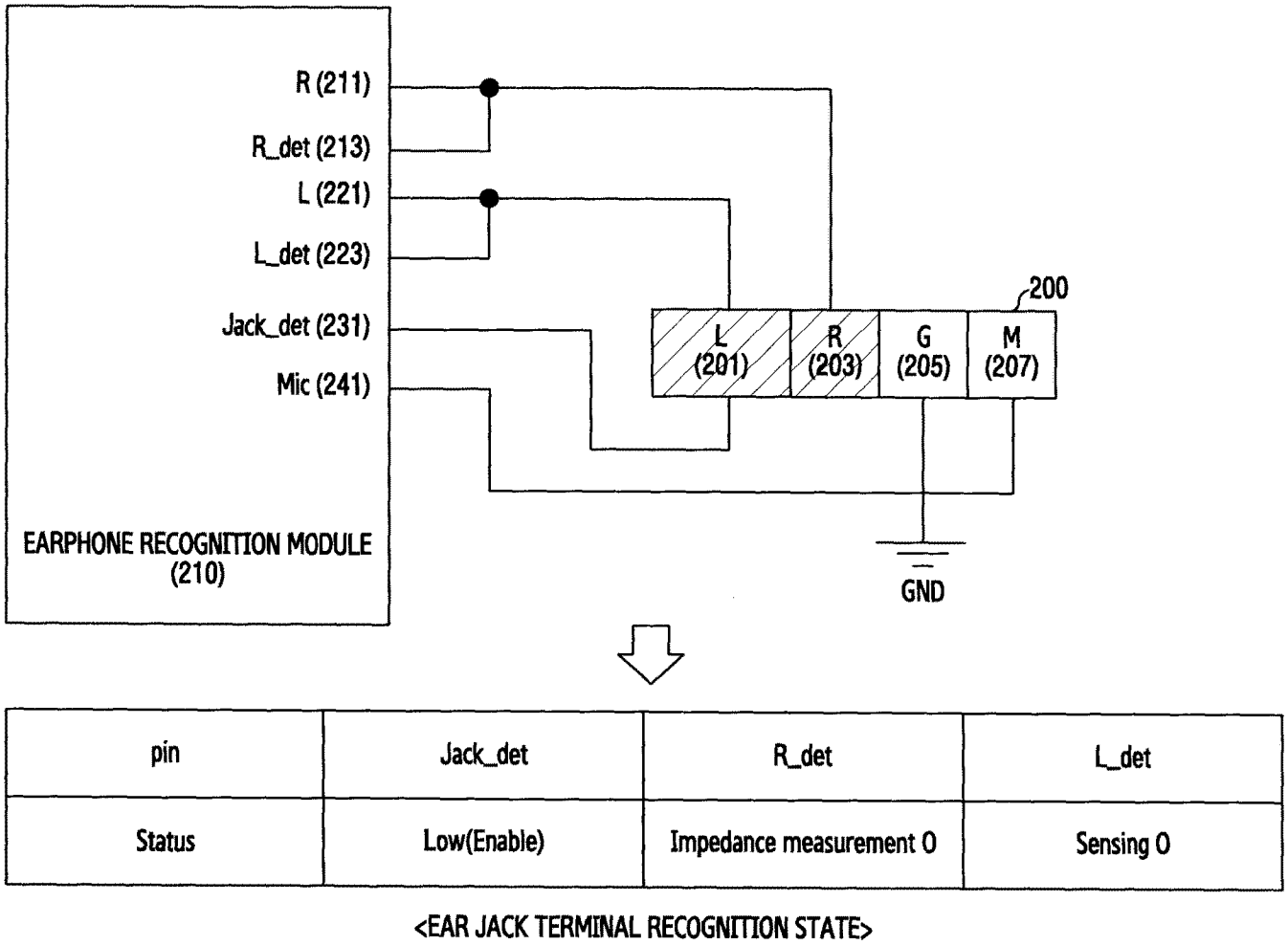
FIG. 5C is a diagram illustrating a third state of an ear jack, according to an embodiment of the present disclosure.

FIG. 5C is a diagram illustrating a third state of the ear jack 200 in which a foreign substance is present in portions 201 and 203 of the ear jack 200, according to an embodiment of the present disclosure.

As shown in FIG. 5C, when the foreign substance enters the ear jack left portion 201 and the ear jack right portion 203 in an electronic device, the earphone recognition module 210 may receive a low signal from the Jack_det pin 231 and detect that the earphone plug or foreign substance is present in the ear jack 200. For example, referring to FIG. 4, when the foreign substance enters the ear jack 200, the bias voltage is divided between the Jack_det pin 231 and the ear jack 200 by the resistance of the earphone plug and a pull-up resistor R1 273 so that a voltage lower than the bias voltage can be provided to the Jack_det pin 231. In this case, the earphone recognition module 210 may determine that a low signal is received at the Jack_det pin 231.

In order to determine whether the earphone plug is inserted or foreign substance enters the ear jack 200, the earphone recognition module 210 may output a foreign substance detection signal to the ear jack right portion 203 through the R_det pin 213 and measure the impedance of the ear jack right portion 203 by using the R_det pin 213. At this time, since the ear jack right portion 203 is in contact with a foreign substance having electrical conductivity, the earphone recognition module 210 may measure the impedance value by the foreign substance detection signal through the R_det pin 213. When the impedance value is measured through the R_det pin 213, the earphone recognition module 210 may detect whether the foreign substance detection signal that is output to the ear jack right portion 203 is received at the L_det pin 223. At this time, since the foreign substance having electrical conductivity enters the ear jack right portion 203 and up to the ear jack left portion 201, the ear jack right portion 203 and the ear jack left portion 201 are electrically connected via the foreign substance, thus the foreign substance detection signal that is output to the ear jack right portion 203 can be received at the ear jack left portion 201. Therefore, the earphone recognition module 210 may detect that the foreign substance detection signal that is output to the ear jack right portion 203 flows through the ear jack left portion 201 and is then received at the L_det pin 223.

According to an embodiment of the present disclosure, as shown in FIG. 5C, when a low signal is detected through the Jack_det pin 231, the impedance value is measurable through the R_det pin 213, and the foreign substance detection signal is received at the L_det pin 223, the earphone recognition module 210 may determine that the foreign substance is present in the ear jack 200.

Figure 5D:
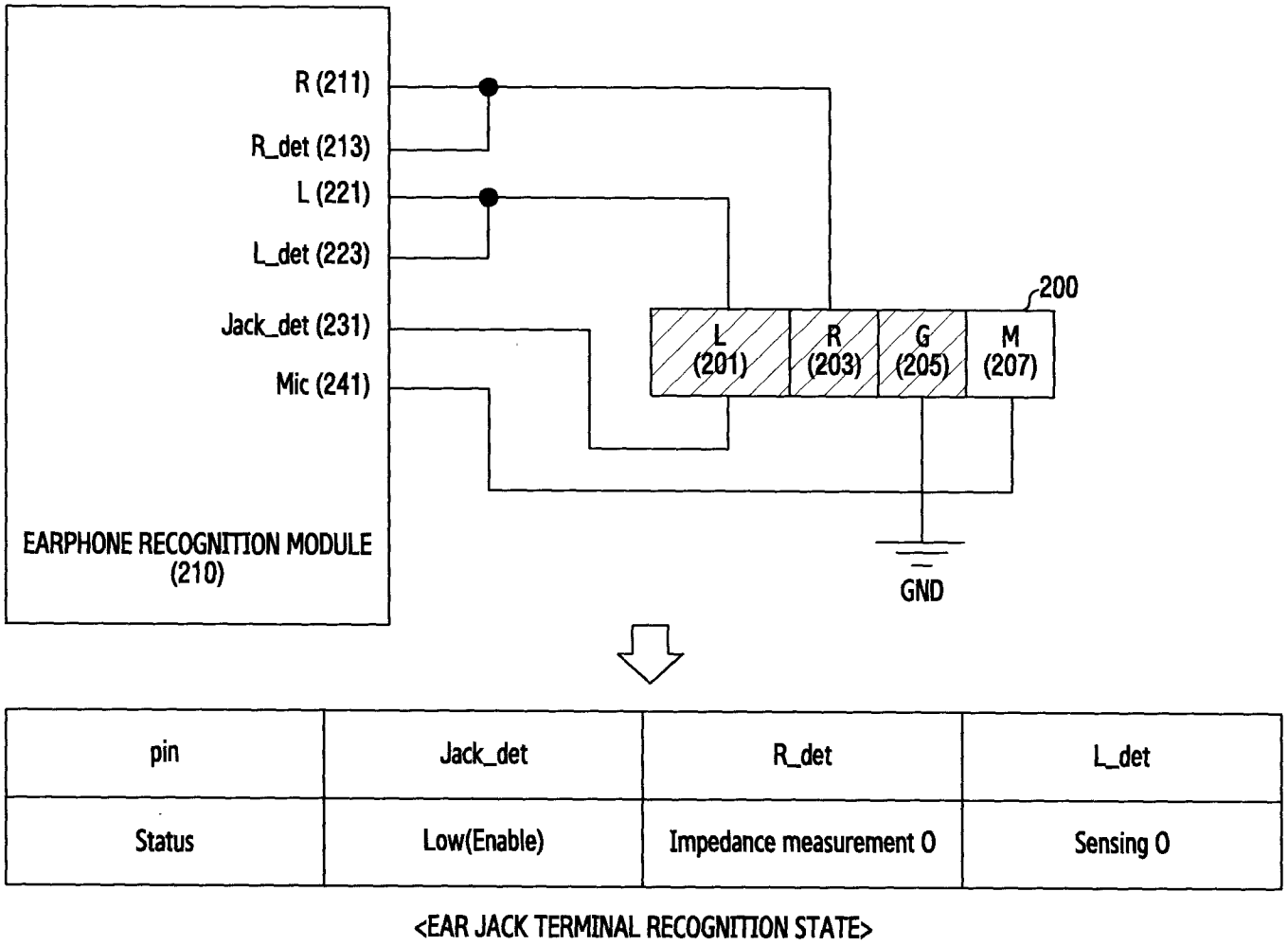
FIG. 5D is a diagram illustrating a fourth state of an ear jack, according to an embodiment of the present disclosure.

FIG. 5D is a diagram illustrating a fourth state of the ear jack 200 in which a foreign substance is present in the portions 201, 203, and 205 of the ear jack 200, according to an embodiment of the present disclosure.

As shown in FIG. 5D, when the foreign substance enters the portions 201, 203, and 205 of the ear jack 200, the earphone recognition module 210 may receive a low signal at the Jack_det pin 231 and detect that the earphone plug or foreign substance is present in the ear jack 200. For example, referring to FIG. 4, when the foreign substance enters the ear jack 200, the bias voltage is divided between the Jack_det pin 231 and the ear jack 200 by the resistance of the foreign substance and a pull-up resistor R1 273 so that a voltage lower than the bias voltage can be provided to the Jack_det pin 231. In this case, the earphone recognition module 210 may determine that the low signal is received at the Jack_det pin 231.

In order to determine whether the earphone plug is inserted or foreign substance has entered the ear jack 200, the earphone recognition module 210 may output a foreign substance detection signal to the ear jack right portion 203 through the R_det pin 213 and measure the impedance using the R_det pin 213. At this time, since the ear jack right portion 203 is in contact with the foreign substance having electrical conductivity, the earphone recognition module 210 may measure the impedance value by the foreign substance detection signal trough the R_det pin 213. When the impedance value is measured through the R_det pin 213, the earphone recognition module 210 may detect whether the foreign substance detection signal that is output to the ear jack right portion 203 is received at the L_det pin 223. At this time, since the foreign substance having electrical conductivity has entered the ear jack right portion 203 and up to the ear jack ground portion 205, the ear jack right portion 203 and the ear jack left portion 201 are electrically connected via the foreign substance, and thus the foreign substance detection signal that is output to the ear jack right portion 203 can be received at the ear jack left portion 201. Therefore, the earphone recognition module 210 may detect that the foreign substance detection signal that is output to the ear jack right portion 203 flows through the ear jack left portion 201 to the L_det pin 223.

According to an embodiment of the present disclosure, as shown in FIG. 5D, when a low signal is detected through the Jack_det pin 231, the impedance value is measurable through the R_det pin 213, and the foreign substance detection signal is received at the L_det pin 223, the earphone recognition module 210 may determine that the foreign substance is present in the ear jack 200.

Figure 5E:
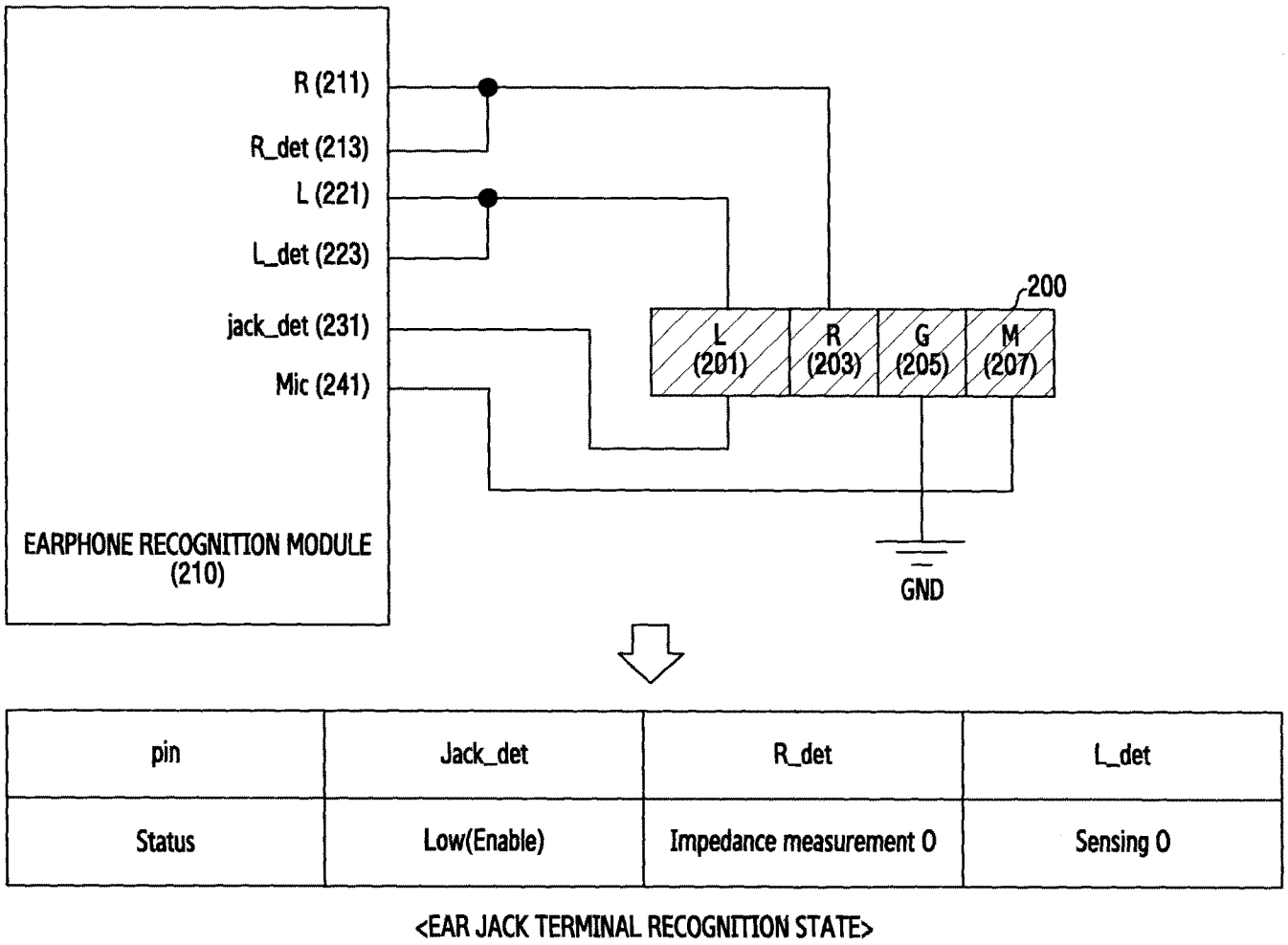
FIG. 5E is a diagram illustrating a fifth state of an ear jack, according to an embodiment of the present disclosure.

FIG. 5E is a diagram illustrating a fifth state of the ear jack 200 in which a foreign substance is present in the portions 201, 203, 205, and 207 of the ear jack 200, according to an embodiment of the present disclosure.

As shown in FIG. 5E, when the foreign substance enters the portions 201, 203, 205, and 207 of the ear jack 200, the earphone recognition module 210 may receive a low signal at the Jack_det pin 231 and detect that the earphone plug or the foreign substance is present in the ear jack 200. For example, referring to FIG. 4, when the foreign substance enters the ear jack 200, the bias voltage is divided between the Jack_det pin (231) and the ear jack 200 by the resistance of the foreign substance and a pull-up resistor R1 273 so that a voltage lower than the bias voltage can be provided to the Jack_det pin 231. In this case, the earphone recognition module 210 may determine that the low signal is received at the Jack_det pin 231. In order to determine whether the earphone plug is inserted or foreign substance has entered the ear jack 200, the earphone recognition module 210 may output a foreign substance detection signal to the ear jack right portion 203 through the R_det pin 213 and measure the impedance of the ear jack right portion 203 using the R_det pin 213. At this time, since the ear Jack right portion 203 is in contact with the foreign substance having electrical conductivity, the earphone recognition module 210 may measure the impedance value by the foreign substance detection signal trough the R_det pin 213. When the impedance value is measured through the R_det pin 213, the earphone recognition module 210 may detect whether the foreign substance detection signal that is output to the ear jack right portion 203 is received at the L_det pin 223. At this time, since the foreign substance having electrical conductivity is present in all portions 201-107 of the ear jack 200, the ear jack right portion 203 and the ear jack left portion 201 are electrically connected via the foreign substance, and thus the foreign substance detection signal that is output to the ear jack right portion 203 can be received to the ear jack left portion 201. Therefore, the earphone recognition module 210 may detect that the foreign substance detection signal that is output to the ear jack right portion 203 flows through the ear jack left portion 201 and is then received at the L_det pin 223.

According to an embodiment of the present disclosure, as shown in FIG. 5E, when a low signal is detected through the Jack_det pin 231, the impedance value is measurable through the R_det pin 213, and the foreign substance detection signal is received at the L_det pin 223, the earphone recognition module 210 may determine that the foreign substance has entered the ear jack 200.

According to an embodiment of the present disclosure, an electronic device may include an ear jack including a plurality of terminals; and a processor that measures the impedance of at least one terminal among the plurality of terminals, and detects whether a foreign substance flows into the ear jack based on the measured impedance.

In an embodiment of the present disclosure, the processor may determine whether at least two terminals among the plurality of terminals are electrically connected to each other based on the measured impedance, and detect whether the foreign substance flows into the ear jack depending on the electrical connectivity of the at least two terminals.

In the embodiment of the present disclosure, the at least two terminals among the plurality of terminals may be configured such that an electrical signal is not transmitted therebetween, and the at least two terminals among the plurality of terminals may be electrically connected by the conductive foreign substance in contact with the at least two terminals.

In an embodiment of the present disclosure, the processor may detect whether an earphone or a foreign substance is present in the ear jack through a first pin connected a first terminal among the plurality of terminals, output a signal to a second pin that is connected to a second terminal among the plurality of terminals, measure the impedance of the second terminal, and determine whether the foreign substance has flowed into the ear jack based on the impedance measurement result.

In the embodiment of the present disclosure, the second terminal is configured to transmit a first audio signal that is output from the processor to the earphone, and the second pin may be connected to the second terminal through a signal line to which the first audio signal is transmitted.

In an embodiment of the present disclosure, when the impedance of the second terminal is measured as high impedance, the processor may determine that a foreign substance has flowed into the ear jack.

In an embodiment of the present disclosure, the signal that is output from the second terminal can be a voltage signal for determining whether the foreign substance has flowed into the ear jack.

In an embodiment of the present disclosure, when the impedance value of the second terminal is measured, the processor may determine whether the foreign substance has flowed into the ear jack based on whether the signal output from the second pin is detected through a third pin connected to the first terminal.

In an embodiment of the present disclosure, the first terminal is configured to transmit the second audio signal that is output from the processor to the earphone, and the third pin can be connected to the first terminal via a signal line to which the second audio signal is transmitted.

In an embodiment of the present disclosure, when the signal output from the second pin is detected through the third pin, the processor may determine that the first terminal and the second terminal are electrically connected to each other and that the foreign substance has flowed into the ear jack.

In an embodiment of the present disclosure, when the signal output from the second pin is not detected through the third pin, the processor may determine that the first terminal and the second terminal are not electrically connected to each other and that an earphone is inserted into the ear jack.

In the embodiment of the present disclosure, the ear jack is configured by including at least one among an ear jack left terminal in contact with a left terminal of the earphone, an ear jack right terminal in contact with a right terminal of the earphone, an ear jack ground terminal in contact with a ground terminal of the earphone, and an ear jack microphone terminal in contact with a microphone terminal of the earphone, wherein the first terminal may be the ear jack left terminal, the second terminal may be the ear jack right terminal, or the first terminal may be the ear jack right terminal, and the second terminal may be the ear jack left terminal.

An embodiment of the present disclosure may further include a display for displaying the inflow of the foreign substance based on the control of the processor when the inflow of the foreign substance into the ear jack is detected.

Figure 6:
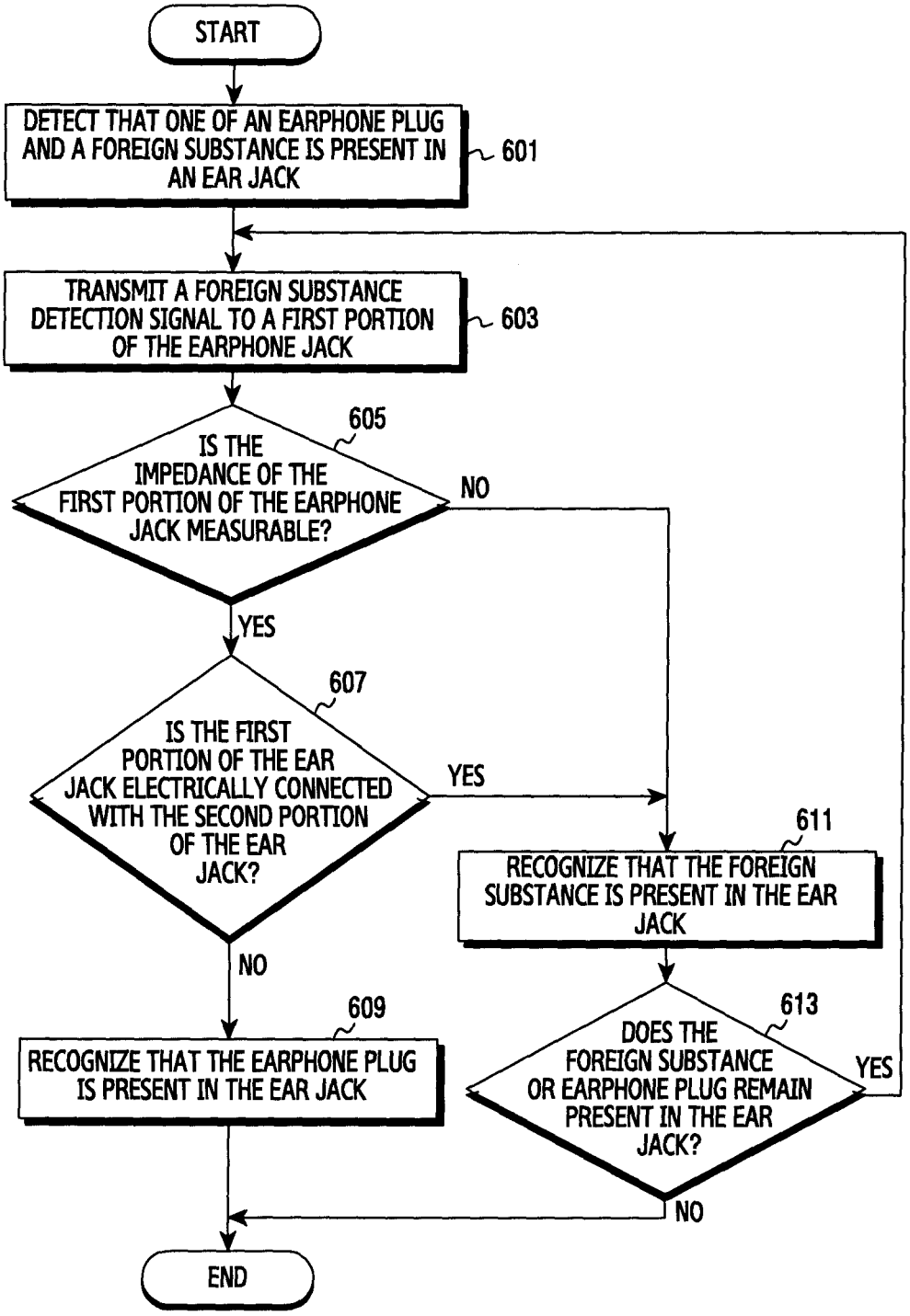
FIG. 6 is a flowchart of an example of a process, according to an embodiment of the present disclosure.

FIG. 6 is a flowchart of an example of a process, according to an embodiment of the present disclosure.

In operation 601, the electronic device detects that one of an earphone plug and a foreign substance is present in the ear jack 200. For example, when a low signal is received at the Jack_det pin 231 that is connected to the ear jack left portion 201, the electronic device may detect that either the earphone plug or the foreign substance is present in the ear jack 200.

Next, the electronic device outputs a foreign substance detection signal to the ear jack right portion 203 in operation 603. For example, the electronic device may output a voltage signal for detecting the foreign substance to the ear jack right portion 203 from the R_det pin 213.

Next, the electronic device detects whether the impedance of the ear jack right portion 203 is measurable in operation 605. For example, the impedance may be considered measurable when the impedance meets a predetermined threshold, whereas the impedance may be considered immeasurable when the impedance fails to meet the predetermined threshold. As another example, the electronic device may measure the impedance of the ear jack right portion 203, due to a voltage signal for detecting the foreign substance, using an R_det pin 213. When the impedance measurement of the ear jack right portion 203 is not possible, for example, the ear jack right portion 203 is in a high impedance state, the electronic device recognizes that the foreign substance has flowed into the ear jack 200, in operation 611.

On the other hand, when the impedance measurement of the ear jack right portion 203 is possible, the electronic device detects whether the ear jack right portion 203 is electrically connected to the ear jack left portion 201, in operation 607. For example, the electronic device may identify whether the foreign substance detection signal, which is output to the ear jack right portion 203 via the R_det pin 213, flows through the ear jack left portion 201 to the L_det pin 223. If the foreign substance detection signal is received at the ear jack left portion 201, the electronic device recognizes that the foreign substance is present in the ear jack 200 in operation 611.

On the other hand, when the foreign substance detection signal is not received at the ear jack left portion 201, the electronic device recognizes that the earphone plug is inserted into the ear jack 200 in operation 609, and terminates the procedure according to an embodiment of the present disclosure.

In operation 613, the electronic device detects whether the earphone plug or the foreign substance remains present in the ear jack. When the foreign substance or ear jack remains present in the ear jack 200, for example, a low signal is continuously input from the Jack_det pin 231 that is connected to the ear jack left portion 201, the electronic device may return to the operation 603 and re-perform following operations.

On the other hand, when the state where the earphone plug or the foreign substance is present in the ear jack is not maintained, for example, a high signal is input from the Jack_det pin 231 that is connected to the ear jack left portion 201, the electronic device recognizes that the earphone plug or the foreign substance does is not present in the ear jack and terminates the procedure according to an embodiment of the present disclosure.

Various embodiments of the disclosure described above have explained a method on the assumption that the earphone plug is configured in the order of the left terminal 251, the right terminal 253, the ear jack ground portion 205, and the ear jack microphone portion 207, and the method is configured by outputting a voltage signal for detecting the foreign substance to the ear jack right portion 203 through the R_det pin 213, measuring the impedance of the ear jack right portion 203 through the R_det pin 213, and detecting a signal input from the ear jack left portion 205 through the L_det pin 223. However, according to various embodiments of the present disclosure, when the order of the left terminal 251 and the right terminal 253 of the earphone plug is changed, for example, the earphone plug is configured in the order of the right terminal 253, the left terminal 251, the ear jack ground portion 205, and the ear jack microphone portion 207, the earphone recognition module 210 may implement the method configured by outputting a voltage signal for detecting the foreign substance through the L_det pin 223, measuring the impedance of the ear jack left portion 205 through the L_det pin 223, and detecting a signal input from the ear jack right portion 203 through the L_det pin 223.

The embodiment of the present disclosure described above is configured such that the ear jack left portion 201 and the ear jack right portion 203 among a plurality of terminals configuring the ear jack 200 are configured not to directly transmit electrical signals to each other, and the embodiment has been described to determine whether the foreign substance has entered the ear jack 200 based on whether the ear jack left portion 201 and the ear jack right portion 203 are electrically connected by the foreign substance having electrical conductivity. However, various embodiments are configured such that any two terminals among a plurality of terminals configuring the ear jack 200 are configured not to directly transmit electrical signals to each other, and the embodiment may determine whether the foreign substance has flowed into the ear jack 200 based on whether any two terminals are electrically connected by the foreign substance having electrical conductivity. For example, an embodiment is configured such that the ear jack right portion 203 and the ear jack ground portion 205 are configured so as not to directly transmit an electrical signal to each other, and checks whether the ear jack right portion 205 and the ear jack ground portion 203 are electrically connected by the foreign substance having electrical conductivity, so that the embodiment may determine whether the foreign substance has entered the ear jack 200. As another example, an embodiment is configured such that the ear jack ground portion 205 and the ear jack microphone portion 207 are configured so as not to directly transmit an electrical signal to each other, and checks whether the ear jack ground portion 205 and the ear jack microphone portion 207 are electrically connected by a foreign substance having electrical conductivity, so that the embodiment may determine whether the foreign substance has entered the ear jack 200. As another example, an embodiment is configured such that the ear jack left portion 201 and the ear jack ground portion 205 are configured so as not to transmit an electrical signal through the ear jack right portion 203, and checks whether the ear jack left portion 201 and the ear jack ground portion 205 are electrically connected by a foreign substance having electrical conductivity, so that the embodiment may determine whether the foreign substance has entered the ear jack 200.

According to an embodiment of the present disclosure, a method for operating an electronic device includes: detecting whether an earphone or a foreign substance is present in an ear jack; and determining which one among the earphone and the foreign substance is present in the ear jack based on the impedance of at least one terminal among a plurality of terminals configuring the ear jack.

According to an embodiment of the present disclosure, the determining of which one among the earphone and the foreign substance is present in the ear jack may include detecting which one among the earphone and the foreign substance is present in the ear jack through a first pin connected to a first terminal among the plurality of terminals.

According to an embodiment of the present disclosure, the determining of which one among the earphone and the foreign substance is present in the ear jack may include: outputting a signal to the second terminal through a second pin connected to a second terminal among the plurality of terminals; measuring the impedance of the second terminal; and determining whether the foreign substance has entered the ear jack based on the result of the impedance measurement.

According to an embodiment of the present disclosure, the determining of whether a foreign substance has entered the ear jack based on the impedance measurement result may further include: when the impedance of the second terminal is determined as high impedance, determining that the second terminal and the first terminal are not electrically connected, and determining that the foreign substance has entered the ear jack.

According to an embodiment of the present disclosure, the determining of whether the foreign substance has entered the ear jack based on the impedance measurement result includes: when an impedance value of the second terminal is measured, determining whether the foreign substance has entered the ear jack based on whether a signal output from the second pin is detected through a third pin connected to the first terminal.

According to an embodiment of the present disclosure, the determining of whether the foreign substance has entered the ear jack based on whether a signal output from the second pin is detected through a third pin connected to the first terminal may include: when the signal output from the second pin is detected through the third pin, determining that the first terminal and the second terminal are electrically connected to each other, and determining that the foreign substance has entered the ear jack.

In an embodiment of the present disclosure, the determining of whether the second terminal and the first terminal are electrically connected to each other based on whether a signal output from the second pin is detected through a third pin connected to the first terminal may include: when the signal output from the second pin is not detected through the third pin, determining that the first terminal and the second terminal are not electrically connected to each other and determining that a foreign substance has entered the ear jack; and when the signal output from the second pin is not detected through the third pin, determining that the first terminal and the second terminal are not electrically connected to each other and determining that an earphone is inserted into the ear jack.

In an embodiment of the present disclosure, the determining of which one among the earphone or the foreign substance is present in the ear jack may include: determining whether at least two terminals among the plurality of terminals are electrically connected to each other based on the measured impedance; and determining whether the foreign substance has entered the ear jack depending on the electrical connectivity of the at least two terminals, wherein at least two terminals among the plurality of terminals may be configured so as to not directly transmit an electrical signal to each other, and the at least two terminals among the plurality of terminals may be electrically connected by a conductive foreign substance in contact with the at least two terminals.

Figure 7:
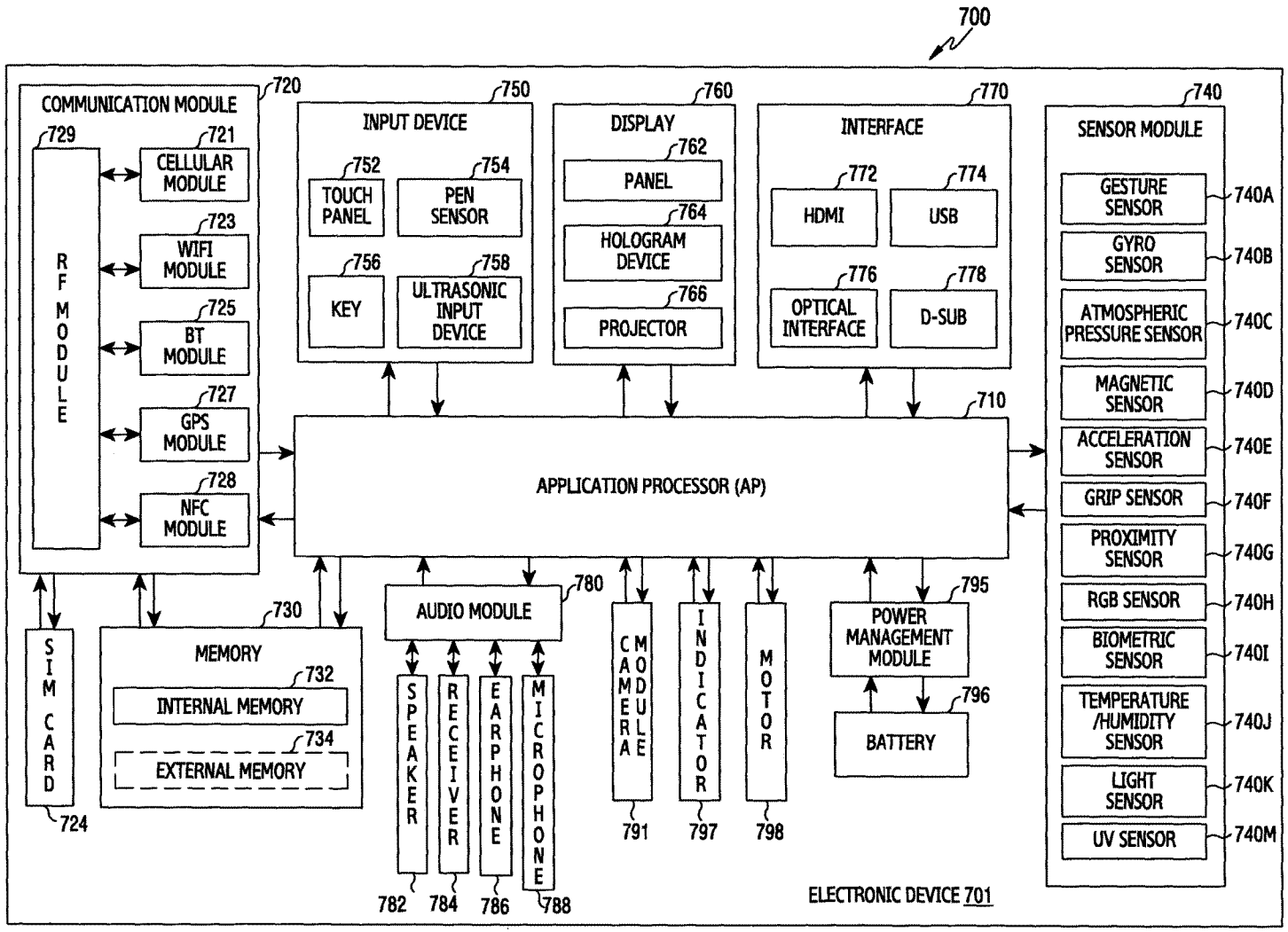
FIG. 7 is a diagram of an example of an electronic device, according to an embodiment of the present disclosure.

FIG. 7 illustrates a block diagram of an electronic device according to various embodiments. The electronic device 700, for example, may constitute all or a part of the electronic device 101 shown in FIG. 1A and FIG. 1B. Referring to FIG. 7, the electronic device 700 may include at least one application processor (AP) 710, a communication module 720, at least one subscriber identity module (SIM) card slots 724, a memory 730, a sensor module 740, an input module 750, a display 760, an interface 770, an audio module 780, a camera module 791, a power management module 795, a battery 796, an indicator 797, and a motor 798.

The AP 710 may drive an operating system or an application program to control a plurality of hardware or software components connected to the AP 710, and may perform processing and operations of various data including multimedia data. The AP 710, for example, may be implemented as a system on chip (SoC). According to an embodiment, the AP 710 may further include a graphic processing unit (GPU) (not shown).

The communication module 720 (e.g., the communication interface 160) may perform data transmission/reception in communication with other electronic devices (e.g., the electronic device 104 and the server 106) connected to the electronic device 700 (e.g., the electronic device 101) through a network. According to an embodiment, the communication module 720 may include a cellular module 721, a WiFi module 723, a BT module 722, a GPS module 727, an NFC module 728, and a radio frequency (RF) module 729.

The cellular module 721 may provide a voice call, a video call, an SMS service, an Internet service, and the like through a communication network (e.g., LTE, LTE-A, CDMA, WCDMA, UMTS, WiBro, or GSM). Also, the cellular module 721 may identify and authenticate an electronic device in a communication network by using, for example, a subscriber identification module (e.g., the SIM card). According to an embodiment, the cellular module 721 may perform at least some of the functions that may be provided by the AP 710. For example, the cellular module 721 may perform at least a multimedia control function.

According to an embodiment, the cellular module 721 may include a communication processor (CP). Further, the cellular module 721, for example, may be implemented as a SoC. Although the cellular module 721 (e.g., a CP), the memory 730, the power management module 795, and the like are shown as separate elements from the AP 710 in FIG. 7, the AP 710 may be implemented to include at least some (e.g., the cellular module 721) of the aforementioned elements according to an embodiment.

According to an embodiment, the AP 710 or the cellular module 721 (e.g., a CP) may load a command or data received from at least one of a non-volatile memory and other elements connected thereto into a volatile memory and process the loaded command or data. Further, the AP 710 or the cellular module 721 may store data received from or generated by at least one of other elements in a non-volatile memory.

Each of the WiFi module 723, the BT module 722, the GPS module 727, and the NFC module 728, for example, may include a processor for processing data transmitted or received through the corresponding module. Although the cellular module 721, the WiFi module 723, the BT module 722, the GPS module 727, and the NFC module 728 are shown as separate blocks in FIG. 7, at least some (e.g., two or more) of the cellular module 721, the WiFi module 723, the BT module 722, the GPS module 727, and the NFC module 728 may be included in one integrated chip (IC) or one IC package according to an embodiment. For example, at least some of processors corresponding to the cellular module 721, the WiFi module 723, the BT module 722, the GPS module 727, and the NFC module 728 respectively (e.g., a CP corresponding to the cellular module 721 and a WiFi processor corresponding to the WiFi module 723) may be implemented as one SoC.

The RF module 729 may perform data transmission/reception, for example, RF signal transmission/reception. Although not shown in the drawing, the RF module 729, for example, may include a transceiver, a power amp module (PAM), a frequency filter, a low noise amplifier (LNA), and the like. Also, the RF module 729 may further include a component for transmitting/receiving an electromagnetic wave over the air in wireless communication, such as a conductor or a conducting wire. Although FIG. 7 shows that the cellular module 721, the WiFi module 723, the BT module 722, the GPS module 727, and the NFC module 728 share one RF module 729, at least one of the cellular module 721, the WiFi module 723, the BT module 722, the GPS module 727, and the NFC module 728 may perform RF signal transmission/reception through a separate RF module according to an embodiment.

The at least one SIM card 724 may be a card including a subscriber identification module, and may be inserted into at least one slot formed in a certain position of the electronic device. The at least one SIM card 724 may include unique identification information (e.g., integrated circuit card identifier (ICCID)) or subscriber information (e.g., international mobile subscriber identity (IMSI)).

The memory 730 (e.g., the memory 130) may include an internal memory 732 or an external memory 734. The internal memory 732, for example, may include at least one of a volatile memory (e.g., a dynamic RAM (DRAM), a static RAM (SRAM), or a synchronous dynamic RAM (SDRAM)) and a non-volatile memory (e.g., a one-time programmable ROM (OTPROM), a programmable ROM (PROM), an erasable and programmable ROM (EPROM), an electrically erasable and programmable ROM (EEPROM), a mask ROM, a flash ROM, a NAND flash memory, or an NOR flash memory).

According to an embodiment, the internal memory 732 may be a solid state drive (SSD). The external memory 734 may further include a flash drive, for example, a compact flash (CF), a secure digital (SD), a micro secure digital (Micro-SD), a mini secure digital (Mini-SD), an extreme digital (xD), or a memory stick. The external memory 734 may be functionally connected to the electronic device 700 through various interfaces. According to an embodiment, the electronic device 700 may further include a storage device (or storage medium) such as a hard drive.

The sensor module 740 may measure a physical quantity or detect an operation state of the electronic device 700 and convert the measured or detected information into an electronic signal. The sensor module 740, for example, may include at least one of a gesture sensor 740A, a gyro sensor 740B, an atmospheric pressure sensor 740C, a magnetic sensor 740D, an acceleration sensor 740E, a grip sensor 740F, a proximity sensor 740G, a color sensor 740H (e.g., a red, green and blue (RGB) sensor), a biometric sensor 740I, a temperature/humidity sensor 740J, a light sensor 740K, and a ultraviolet (UV) sensor 740M. Additionally or alternatively, the sensor module 740, for example, may include an E-nose sensor (not shown), an electromyography (EMG) sensor (not shown), an electroencephalogram (EEG) sensor (not shown), an electrocardiogram (ECG) sensor (not shown), an infrared (IR) sensor (not shown), an iris scanner (not shown), and/or a fingerprint sensor (not shown). The sensor module 740 may further include a control circuit for controlling one or more sensors included therein.

The input module 750 may include a touch panel 752, a (digital) pen sensor 754, a key 756, or an ultrasonic input unit 758. The touch panel 752 that recognizes a touch input, for example, may include at least one of a capacitive touch panel, a resistive touch panel, an infrared touch panel, and an acoustic wave touch panel. Also, the touch panel 752 may further include a control circuit. When the touch panel is a capacitive touch panel, it may recognize a physical contact or proximity. The touch panel 752 may also further include a tactile layer. In this case, the touch panel 752 may provide a tactile response to a user.

The (digital) pen sensor 754, for example, may be implemented using a means identical or similar to a means for receiving a touch input from a user or using a separate recognition sheet. The key 756, for example, may include a physical button, an optical key, or a keypad. The ultrasonic input unit 758 is a unit that can identify data by generating an ultrasonic signal through an input tool and detecting a sonic wave through a microphone (e.g., the microphone 688) in the electronic device 600, and is capable of wireless recognition. According to an embodiment, the electronic device 700 may also receive a user input from an external device (e.g., computer or server) connected thereto by using the communication module 720.

The display 760 (e.g., the display 160) may include a panel 762, a hologram unit 764, or a projector 766. The panel 762, for example, may be a liquid crystal display (LCD) or an active matrix-organic light emitting diode (AM-OLED). The panel 762, for example, may be implemented to be flexible, transparent, or wearable. The panel 762 may also be incorporated into one module together with the touch panel 752. The hologram unit 764 may show a stereoscopic image in the air by using light interference. The projector 766 may display an image by projecting light onto a screen. The screen, for example, may be located inside or outside of the electronic device 700. According to an embodiment, the display 760 may further include a control circuit for controlling the panel 762, the hologram unit 764, or the projector 766.

The interface 770, for example, may include a high-definition multimedia interface (HDMI) 772, a universal serial bus (USB) 774, an optical interface 776, or a D-sub-miniature (D-sub) 778. The interface 770, for example, may be included in the communication interface 170 shown in FIG. 1A. Additionally or alternatively, the interface 790, for example, may include a mobile high-definition link (MHL) interface, a secure digital (SD) card/multimedia card (MMC) interface, or an infrared data association (IrDA) interface.

The audio module 780 may provide bi-directional conversion between a sound and an electronic signal. At least some elements of the audio module 780, for example, may be included in the input/output interface 150 shown in FIG. 1A. The audio module 780, for example, may process sound information input or output through a speaker 782, a receiver 784, earphones 786, or the microphone 788.

The camera module 791 is a device that can take both still and moving images, and according to an embodiment, may include one or more image sensors (e.g., a front sensor or a rear sensor, not shown), a lens (not shown), an image signal processor (ISP) (not shown), or a flash (e.g., an LED or xenon lamp, not shown).

The power management module 795 may manage the power supply of the electronic device 700. Although not shown, the power management module 795, for example, may include a power management integrated circuit (PMIC), a charger IC, or a battery or fuel gauge.

The PMIC, for example, may be mounted in an IC or a SoC semiconductor. Charging methods may be classified into wired charging and wireless charging. The charger IC may charge a battery, and may prevent an overvoltage or excess current from being induced or flowing from a charger. According to an embodiment, the charger IC may include a charger IC for at least one of the wired charging and the wireless charging. Examples of the wireless charging include magnetic resonance charging, magnetic induction charging, and electromagnetic charging, and an additional circuit such as a coil loop, a resonance circuit, and a rectifier may be added for the wireless charging.

The battery gauge, for example, may measure the residual capacity, charge in voltage, current, or temperature of the battery 796. The battery 796 may store or generate electricity, and may supply power to the electronic device 700 by using the stored or generated electricity. The battery 796, for example, may include a rechargeable battery or a solar battery.

The indicator 797 may display a specific status of the electronic device 700 or a part thereof (e.g., the AP 710), for example, a boot-up status, a message status, or a charging status. The motor 798 may convert an electrical signal into a mechanical vibration.

Although not shown, the electronic device 700 may include a processing unit (e.g., GPU) for supporting a mobile TV. The processing unit for supporting a mobile TV may process media data pursuant to a certain standard, for example, digital multimedia broadcasting (DMB), digital video broadcasting (DVB), or media flow.

Each of the above-described elements of the electronic device according to the present disclosure may be formed by one or more components, and the names of the corresponding elements may vary according to the type of the electronic device. The electronic device according to the present disclosure may include at least one of the above-described elements, and may exclude some of the elements or further include other additional elements. Further, some of the elements of the electronic device according to the present disclosure may be coupled to form a single entity while performing the same functions as those of the corresponding elements before the coupling.

The term "module" as used in the present disclosure, for example, may mean a unit including one of hardware, software, and firmware or any combination of two or more of them. The "module", for example, may be interchangeable with the term "unit", "logic", "logical block", "component", or "circuit". The "module" may be the smallest unit of an integrated component or a part thereof. The "module" may be the smallest unit that performs one or more functions or a part thereof. The "module" may be mechanically or electronically implemented. For example, the "module" according to the present disclosure may include at least one of an application-specific integrated circuit (ASIC) chip, a field-programmable gate arrays (FPGA), and a programmable-logic device for performing certain operations.

At least some of the devices (e.g., modules or functions thereof) or methods (e.g., operations) according to various embodiments of the present disclosure, for example, may be implemented by an instruction stored in a computer-readable storage medium in the form of a programming module. The instruction, when executed by at least one processor (e.g., the processor 120), enables the at least one processor to perform a function corresponding to the instruction. The computer-readable storage medium, for example, may be the memory 130. At least a part of the programming module, for example, may be implemented (e.g., executed) by the processor 120. At least a part of the programming module, for example, may include a module, a program, a routine, a set of instructions, or a process for performing at least one function.

The computer-readable recording medium may include magnetic media such as a hard disc, a floppy disc, and a magnetic tape, optical media such as a compact disc read-only memory (CD-ROM) and a digital versatile disc (DVD), magneto-optical media such as a floptical disk, and hardware devices specifically configured to store and execute a program instruction (e.g., programming module), such as a read only memory (ROM), a random-access memory (RAM), and a flash memory. Further, the program instruction may include high-class language codes that can be executed in a computer by using an interpreter, as well as machine language codes that are made by a compiler. Any of the hardware devices as described above may be configured as one or more software modules in order to perform the operations according to various embodiments of the present disclosure, and vice versa.

Any of the modules or programming modules according to the present disclosure may include at least one of the above-described elements, exclude some of the elements, or further include other additional elements. The operations performed by the modules, programming modules, or other elements according to the present disclosure may be executed in a sequential, parallel, repetitive, or heuristic manner. Further, some of the operations may be executed in a different order, some of the operations may be omitted, or other operations may be added.

FIGS. 1-7 are provided as an example only. At least some of the operations discussed with respect to these figures can be performed concurrently, performed in different order, and/or altogether omitted. It will be understood that the provision of the examples described herein, as well as clauses phrased as "such as," "e.g.", "including", "in some aspects," "in some implementations," and the like should not be interpreted as limiting the claimed subject matter to the specific examples. Although the above examples are provided in the context of ear jacks, it will be understood the concepts disclosed herein can be used to detect the presence of foreign substances in any suitable type of connector, such as a USB connector, an HDMI connector, by: measuring the impedance of a first portion of the connector, and/or detecting whether the first portion of the connector is electrically connected to another portion of the connect.

Any of the functions and steps provided in the Figures may be implemented in hardware, software or a combination of both and may be performed in whole or in part within the programmed instructions of a computer. No claim element herein is to be construed under the provisions of 35 U.S.C. 112, sixth paragraph, unless the element is expressly recited using the phrase "means for".

While the present disclosure has been particularly shown and described with reference to the examples provided therein, it will be understood by those skilled in the art that various changes in form and details may be made therein without departing from the spirit and scope of the present disclosure as defined by the appended claims.

What is claimed is:

1. An electronic device comprising:

a memory;

a headphone jack; and at least one processor operatively coupled to the memory, configured to:

detect an impedance of a first portion of the headphone jack;

detect whether a second portion of the headphone jack detects a signal if the impedance of the first portion of the headphone jack is detected;

determine that a headphone plug is inserted into the headphone jack if the second portion of the headphone jack does not detect the signal; and determine that a foreign substance is present in the headphone jack if the second portion of the headphone jack detects the signal, and display a message requesting a user to remove the foreign substance from the headphone jack.

2. The electronic device of claim 1, wherein the first portion of the headphone jack and the second portion of the headphone jack are not electrically connected with one another if the headphone jack is empty or if the headphone plug is inserted in the headphone jack.

3. The electronic device of claim 1, further comprising:

detecting a bias voltage drop, outputting the signal to the first portion of the headphone jack from a first pin, and detecting whether the first portion of the headphone jack is electrically connected with the second portion of the headphone jack based on the signal.

4. The electronic device of claim 3, wherein:

the first portion of the headphone jack is for transmitting a first audio signal, and the first pin is electrically connected to a signal line that carries the first audio signal to the first portion of the headphone jack.

5. The electronic device of claim 3, wherein the at least one processor determines that the foreign substance is present in the headphone jack in response to the impedance of the first portion of the headphone jack meeting a threshold.

6. The electronic device of claim 3, wherein the signal comprises a voltage signal.

7. The electronic device of claim 3, wherein detecting whether the first portion of the headphone jack is electrically connected with the second portion of the headphone jack includes detecting whether the signal flows from the first pin to a second pin that is coupled to the second portion of the headphone jack.

8. The electronic device of claim 7, wherein:

the second portion of the headphone jack is for transmitting a second audio signal, and the second pin is electrically connected to the second portion of the headphone jack via a signal line that carries the second audio signal to the second portion of the headphone jack.

9. The electronic device of claim 7, wherein the at least one processor detects that the foreign substance is present in the headphone jack, if the signal flows from the first pin to the second pin.

10. The electronic device of claim 7, wherein the at least one processor detects that the headphone plug is inserted in the headphone jack, if the signal does not flow from the first pin to the second pin.

11. The electronic device of claim 3, wherein the first portion of the headphone jack includes a headphone jack right portion, the second portion of the headphone jack includes a headphone jack left portion, and the headphone jack further includes a headphone jack ground portion, and a headphone jack microphone portion.

12. A method comprising:

detecting, by at least one processor, an impedance of a first portion of an headphone jack;

detecting whether a second portion of the headphone jack detects a signal if the impedance of the first portion of the headphone jack is detected;

determining that a headphone plug is inserted into the headphone jack if the second portion of the headphone jack does not detect the signal; and determining that a foreign substance is present in the headphone jack if the second portion of the headphone jack detects the signal, and displaying a message requesting a user to remove the foreign substance from the headphone jack.

13. The method of claim 12, further comprising:

outputting a signal to the first portion of the headphone jack from a first pin, the signal being used to detect the impedance of the first portion, and detecting whether the first portion of the headphone jack is electrically connected with a second portion of the headphone jack based on the signal.

14. The method of claim 13, wherein determining that the foreign substance is present in the headphone jack comprises detecting that the foreign substance is present in the headphone jack if the impedance of the first portion of the headphone jack meets a threshold.

15. The method of claim 13, wherein detecting whether the first portion of the headphone jack is electrically connected with a second portion of the headphone jack comprises detecting whether the signal flows from a first pin coupled to the first portion of the headphone jack to a second pin that is coupled to the second portion of the headphone jack.

16. The method of claim 15, wherein determining that the foreign substance is present in the headphone jack comprises:

if the signal flows from the first to the second pin, detecting that the foreign substance is present in the headphone jack; and if the signal does not flow from the first pin to the second pin, detecting that the headphone plug is inserted in the headphone jack.

17. The method of claim 12, wherein:

the first portion of the headphone jack and the second portion of the headphone jack are not electrically connected with one another if the headphone jack is empty or if the headphone plug is inserted in the headphone jack.

* * * * *